US008135588B2

(12) United States Patent
Oshikiri et al.

(10) Patent No.: US 8,135,588 B2
(45) Date of Patent: Mar. 13, 2012

(54) TRANSFORM CODER AND TRANSFORM CODING METHOD

(75) Inventors: Masahiro Oshikiri, Kanagawa (JP); Tomofumi Yamanashi, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1006 days.

(21) Appl. No.: 12/089,985

(22) PCT Filed: Oct. 13, 2006

(86) PCT No.: PCT/JP2006/320457

§ 371 (c)(1),
(2), (4) Date: Apr. 11, 2008

(87) PCT Pub. No.: WO2007/043648

PCT Pub. Date: Apr. 19, 2007

(65) Prior Publication Data

US 2009/0281811 A1 Nov. 12, 2009

(30) Foreign Application Priority Data

Oct. 14, 2005 (JP) ..... 2005-300778
Oct. 3, 2006 (JP) ..... 2006-272251

(51) Int. Cl.
*G10L 19/02* (2006.01)

(52) U.S. Cl. ..... 704/229; 704/230; 704/500

(58) Field of Classification Search ..... 704/229, 704/230, 500

See application file for complete search history.

(56) References Cited

U.S. PATENT DOCUMENTS 5,627,938 A * 5/1997 Johnston ..... 704/200.1
5,649,051 A * 7/1997 Rothweiler et al. ..... 704/222
5,651,090 A * 7/1997 Moriya et al. ..... 704/200.1
5,664,054 A 9/1997 Su
5,710,863 A * 1/1998 Chen ..... 704/200.1
5,864,794 A * 1/1999 Tasaki ..... 704/200.1
6,167,375 A * 12/2000 Miseki et al. ..... 704/229
6,345,246 B1 * 2/2002 Moriya et al. ..... 704/219
6,704,702 B2 * 3/2004 Oshikiri et al. ..... 704/207

(Continued)

FOREIGN PATENT DOCUMENTS

JP 6-51795 2/1994

(Continued)

OTHER PUBLICATIONS

Bosi et al. "ISO/IECMPEG-2AdvancedAudio Coding" 1997.*

(Continued)

*Primary Examiner* — Richemond Dorvil
*Assistant Examiner* — Greg Borsetti
(74) *Attorney, Agent, or Firm* — Greenblum & Bernstein, P.L.C.

(57) ABSTRACT

A transform coder leading to reduction of degradation of perceptual sound quality even if an adequate number of bits is not assigned. Candidates of a correction scale factor stored in a correction scale factor codebook are outputted one by one, and an error signal is generated by subjecting the candidate and scale factors outputted from scale factor computing sections to a predetermined operation. A judging section determines a weight vector given to a weighted error computing section depending on the sign of the error signal. The weighted error computing section computes the square of the error signal, multiplies the square of the error signal by the weight vector given from the judging section and computes a weighted squared error E. A search section determines the candidates of the correction scale factor which minimizes the weighted squared error E by a closed loop processing.

10 Claims, 25 Drawing Sheets

U.S. PATENT DOCUMENTS

| | | | | |
|---|---|---|---|---|
| 6,708,145 | B1 * | 3/2004 | Liljeryd et al. | 704/200.1 |
| 6,934,677 | B2 * | 8/2005 | Chen et al. | 704/200.1 |
| 6,980,951 | B2 * | 12/2005 | Chen | 704/222 |
| 7,054,807 | B2 * | 5/2006 | Mittal et al. | 704/223 |
| 7,058,571 | B2 * | 6/2006 | Tsushima et al. | 704/225 |
| 7,328,152 | B2 * | 2/2008 | Yang et al. | 704/229 |
| 7,349,842 | B2 * | 3/2008 | Youn | 704/229 |
| 7,539,612 | B2 * | 5/2009 | Thumpudi et al. | 704/200.1 |
| 7,613,607 | B2 * | 11/2009 | Valve et al. | 704/225 |
| 7,702,514 | B2 * | 4/2010 | Lin et al. | 704/500 |
| 7,873,514 | B2 * | 1/2011 | Ramprashad | 704/222 |
| 2002/0007273 | A1 * | 1/2002 | Chen | 704/229 |
| 2003/0004713 | A1 | 1/2003 | Makino et al. | |
| 2003/0212551 | A1 * | 11/2003 | Rose et al. | 704/230 |
| 2004/0002856 | A1 * | 1/2004 | Bhaskar et al. | 704/219 |
| 2004/0049382 | A1 * | 3/2004 | Yamaura et al. | 704/226 |
| 2005/0163323 | A1 * | 7/2005 | Oshikiri | 381/22 |
| 2006/0241942 | A1 * | 10/2006 | Chen et al. | 704/230 |
| 2006/0277038 | A1 * | 12/2006 | Vos et al. | 704/219 |
| 2007/0016427 | A1 * | 1/2007 | Thumpudi et al. | 704/500 |
| 2007/0174063 | A1 * | 7/2007 | Mehrotra et al. | 704/501 |
| 2008/0027718 | A1 * | 1/2008 | Krishnan et al. | 704/211 |
| 2008/0040107 | A1 * | 2/2008 | Ramprashad | 704/230 |
| 2008/0040120 | A1 * | 2/2008 | Kurniawati et al. | 704/500 |
| 2008/0126086 | A1 * | 5/2008 | Vos et al. | 704/225 |

FOREIGN PATENT DOCUMENTS

| | | |
|---|---|---|
| JP | 9-190198 | 7/1997 |
| JP | 9-230898 | 9/1997 |
| JP | 2001-255892 | 9/2001 |
| JP | 2002-91498 | 3/2002 |
| JP | 2002-335161 | 11/2002 |
| JP | 2003-273747 | 9/2003 |

OTHER PUBLICATIONS

Herre et al. "The Integrated Filterbank Based Scalable MPEG-4 AUdio Coder" 1998.*
Vilermo et al. "Perceptual Optimization of the Frequency Selective Switch in Scalable Audio Coding" 2003.*
Herre et al. "Extending the MPEG-4 AAC Codec by Perceptual Noise Substitution" 1998.*
Iwakama et al. "Transform-Domain Weighted Interleave Vector Quantization (TwinVQ)" 1996.*
Herre et al. "Temporal Noise Shaping, Quantization and Coding Methods in Perceptual Audio Coding: A Tutorial Introduction" 1999.*
Kandadai et al. "Reverse Engineering Vector Quantizers for Repartitioned Signal Spaces" Nov. 1, 2005.*
Moriya et al. "A Design of Error Robust Scalable Coder Based on MPEG-4/Audio" 2000.*
Moriya et al. "Extension and Complexity Reduction of TwinVQ Audio Coder" 1996.*
Iwakami et al. "Fast Encoding Algorithms for MPEG-4 TwinVQ Audio Tool" 2001.*
Hwang et al. "An MPEG-4 Twin-VQ Based High Quality Audio Codec Design" 2001.*
Geiger et al. "Fine Grain Scalable Perceptual and Lossless Audio Coding Based on INTMDCT" 2003.*
Brandenburg et al. "MPEG-4 natural audio coding" 2000.*
Aggarwal et al. "Efficient Bit-Rate Scalability for Weighted Squared Error Optimization in Audio Coding" Jul. 2006.*
S. Kandadai and C.D. Creusere, "Reverse engineering vector quantizers using training set synthesis," Proceedings of the European Conference on Signal Processing, pp. 789-792, Sep. 2004, Vienna, Austria.*
Heusdens. "Rate-Distortion Optimal Sinusoidal Modeling of Audio and Speech Using Psychoacoustical Matching Pursuits" 2002.*
Huang et al. "A New Audio Coding Scheme Using a Forward Masking Model and Perceptually Weighted Vector Quantization" 2002.*
Ikeda et al. "Audio Transfer System on PHS Using Error-Protected Stereo Twin VQ" 1998.*
"Everything about MPEG-4 (MPEG-4 no subete)," the first edition, written and edited by Sukeichi Miki, Kogyo Chosakai Publishing, Inc., Sep. 30, 1998, pp. 126-127, together with an English language partial translation thereof.
Iwakami et al., "Audio Coding Using Transform-Domain Weighted Interleave Vector Quantization (Twin VQ)," The Transactions of the Institute of Electronics, Information and Communicaiton Engineers. A, May 1997, vol. J80-A, No. 5, pp. 830-837, together with an English language partial translation thereof.
International Search Report mailed Jan. 16, 2007 in the corresponding International Application No. PCT/JP2006/320457.
Iwakami et al., "Audio Coding Using Transform-Domain Weighted Interleave Vector Quantization (Twin VQ)," Electronics and Communications in Japan, Part 3, vol. 81, No. 3, Mar. 1, 1998, pp. 1-9.
Mahieux et al., "High-Quality Audio Transform Coding at 64 kbps," 8089 IEEE Transactions on Communications, vol. 42, No. 11, Nov. 1 1994, pp. 3010-3019.
Supplementary European Search Report, dated Oct. 12, 2011, for corresponding European Patent Application No. 06821860.

* cited by examiner

TRANSFORM CODER AND TRANSFORM CODING METHOD

TECHNICAL FIELD

The present invention relates to a transform coding apparatus and transform coding method for encoding input signals in the frequency domain.

BACKGROUND ART

A mobile communication system is required to compress speech signals in low bit rates for effective use of radio resources. Further, improvement of communication speech quality and realization of a communication service of high actuality are demanded. To meet these demands, it is preferable to make quality of speech signals high and encode signals other than speech signals, such as audio signals in wider bands, with high quality. For this reason, a technique of integrating a plurality of coding techniques in layers is regarded as promising.

For example, this technique refers to integrating in layers the first layer where input signals according to models suitable for speech signals are encoded at low bit rates and the second layer where error signals between input signals and first layer decoded signals are encoded according to a model suitable for signals other than speech (for example, see Non-Patent Document 1). Here, a case is shown where scalable coding is carried out using a standardized technique with MPEG-4 (Moving Picture Experts Group phase-4). To be more specific, CELP (code excited linear prediction) suitable for speech signals is used in the first layer and transform coding such as AAC (advanced audio coder) and TwinVQ (transform domain weighted interleave vector quantization) is used in the second layer when encoding residual signals obtained by removing first layer decoded signals from original signals.

By the way, the TwinVQ transform coding refers to a technique for carrying out MDCT (Modified Discrete Cosine Transform) of input signals and normalizing the obtained MDCT coefficient using a spectral envelope and average amplitude per Bark scale (for example, Non-Patent Document 2). Here, LPC coefficients representing the spectral envelope and the average amplitude value per Bark scale are each encoded separately, and the normalized MDCT coefficients are interleaved, divided into subvectors and subjected to vector quantization. Particularly, the spectral envelope and average amplitude per Bark scale are referred to as "scale factors," and, if the normalized MDCT coefficients are referred to as "spectral fine structure" (hereinafter the "fine spectrum"), TwinVQ is a technique of separating the MDCT coefficients to the scale factors and the fine spectrum and encoding the result.

In transform coding such as TwinVQ, scale factors are used to control energy of the fine spectrum. For this reason, the influence of scale factors upon subjective quality (i.e. human perceptual quality) is significant, and, when coding distortion of scale factors is great, subjective quality is deteriorated greatly. Therefore, high coding performance of scale factors is important.

Non-Patent Document 1: "Everything about MPEG-4" (MPEG-4 no subete), the first edition, written and edited by Sukeichi MIKI, Kogyo Chosakai Publishing, Inc., Sep. 30, 1998, page 126 to 127.

Non-Patent Document 2: "Audio Coding Using Transform-Domain Weighted Interleave Vector Quantization (TwinVQ)," written by Naoki IWAKAMI, Takehiro MORIYA, Satoshi MIKI, Kazunaga IKEDA and Akio JIN, The Transactions of the Institute of Electronics, Information and Communication Engineers. A, May 1997, vol. J80-A, No. 5, pp. 830-837.

DISCLOSURE OF INVENTION

Problems to be Solved by the Invention

In TwinVQ, information equivalent to scale factors is represented by the spectral envelope and the average amplitude per Bark scale. For example, to focus upon the average amplitude per Bark scale, the technique disclosed in Non-Patent Document 2 determines an average amplitude vector per Bark scale that minimizes weighted square error d represented by the following equation, per Bark scale.

(Equation 1)

$$d = \sum_i w_i \cdot (E_i - C_i(m))^2 \quad [1]$$

Here, i is the Bark scale number, $E_i$ is the i-th Bark average amplitude and $C_i(m)$ is the m-th average amplitude vector recorded in an average amplitude codebook.

Weight function $w_i$ represented by above equation 1 is the function per Bark scale, that is, the function of frequency, and when Bark scale i is the same, weight $w_i$ multiplied upon the difference $(E_i - C_i(m))$ between an input scale factor and a quantization candidate is the same at all times.

Further, $w_i$ is the weight associated with the Bark scale, and is calculated based on the size of the spectral envelope. For example, the weight for the average amplitude with respect to a band of a small spectral envelope is a small value, and the weight for the average amplitude with respect to a band of a large spectral envelope is a large value. Therefore, the weight for the average amplitude with respect to a band of a large spectral envelope is set greater, and, as a result, coding is carried out placing significance upon this band. By contrast with this, the weight for the average amplitude with respect to a band of a small spectral envelope is set lower, and so the significance of this band is low.

Generally, the influence of a band of a large spectral envelope upon speech quality is significant, and so it is important to accurately represent the spectrum belonging to this band in order to improve speech quality. However, with the technique disclosed in Non-Patent Document 2, if the number of bits allocated to quantize average amplitude is decreased to realize lower bit rates, the number of bits will be insufficient, which limits the number of candidates of average amplitude vector C(m). Therefore, even if an average amplitude vector satisfying above equation 1 is determined, its quantization distortion increases and there is a problem that speech quality is deteriorated.

It is therefore an object of the present invention to provide a transform coding apparatus and transform coding method that are able to reduce speech quality deterioration even when the number of assigned bits is insufficient.

Means for Solving the Problem

The transform coding apparatus according to the present invention employs a configuration including: an input scale factor calculating section that calculates a plurality of input scale factors associated with an input spectrum; a codebook that stores a plurality of scale factors and outputs one of the plurality of scale factors; a distortion calculating section that calculates distortion between the one of the plurality of input scale factors and the scale factor outputted from the codebook; a weighted distortion calculating section that calculates weighted distortion such that the distortion of when the one of the plurality of input scale factors is smaller than the scale factor outputted from the codebook, is added more weight than the distortion of when the one of the plurality of input scale factors is greater than the scale factor outputted from the codebook; and a searching section that searches for a scale factor that minimizes the weighted distortion in the codebook.

Advantageous Effect of the Invention

The present invention is able to reduce perceptual speech quality deterioration under a low bit rate environment.

BEST MODE FOR CARRYING OUT THE INVENTION

Two cases are classified here where the present invention is applied to scalable coding and where the present invention is applied to single layer coding. Here, scalable coding refers to a coding scheme with a layer structure formed with a plurality of layers, and has a feature that coding parameters generated in each layer have scalability. That is, scalable coding has a feature that decoded signals with a certain level of quality can be obtained from the coding parameters of part of the layers (i.e. lower layers) among coding parameters of a plurality of layers and high quality decoded signals can be obtained by carrying out decoding using more coding parameters.

Then, cases will be described with Embodiments 1 to 3 and 5 to 8 where the present invention is applied to scalable coding and a case will be described with Embodiment 4 where the present invention is applied to single layer coding. Further, in Embodiment 1 to 3 and 5 to 8, the following cases will be described as examples.

(1) Scalable coding of a two-layered structure formed with the first layer and the second layer, which is higher than the first layer, that is, the lower layer and the upper layer, is carried out.

(2) Band scalable coding where the coding parameters have scalability in the frequency domain, is carried out.

(3) In the second layer, coding in the frequency domain, that is, transform coding, is carried out, and MDCT (Modified Discrete Cosine Transform) is used as the transform scheme.

Further, cases will be described with all embodiments as examples where the present invention is applied to speech signal coding. Hereinafter, embodiments of the present invention will be described with reference to attached drawings.

Embodiment 1

Figure 1:
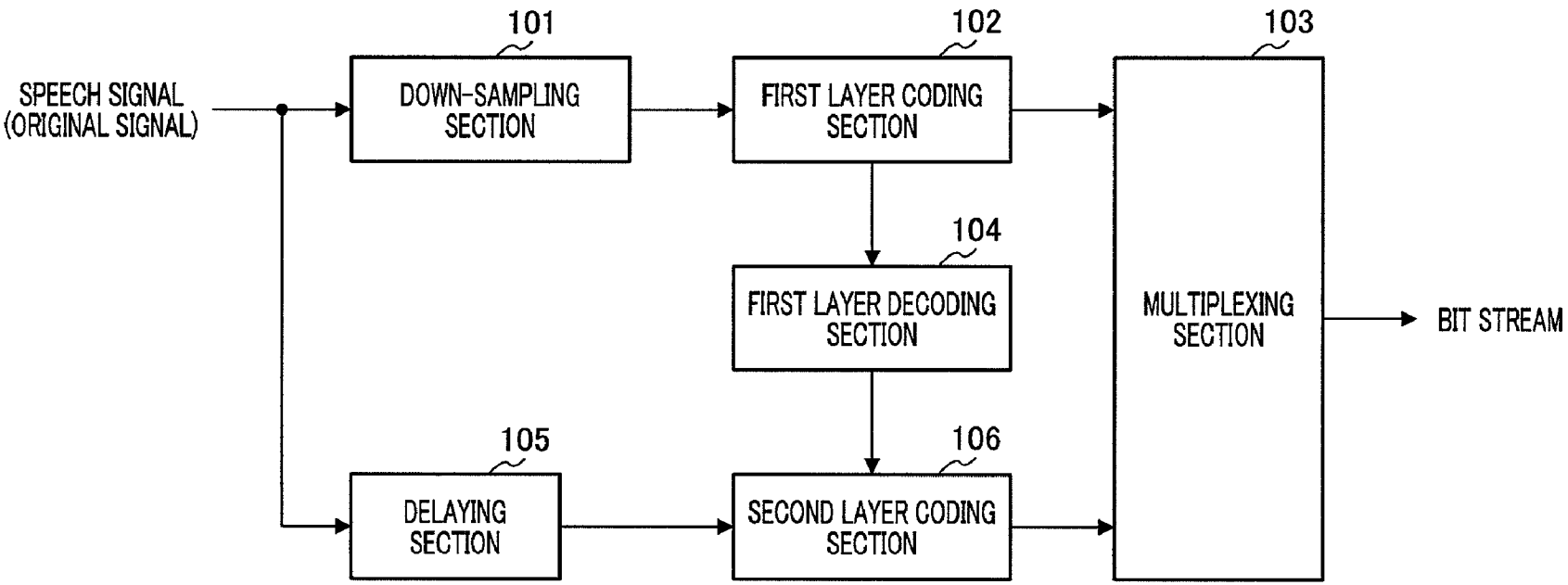
FIG. 1 is a block diagram showing the main configuration of a scalable coding apparatus according to Embodiment 1.

FIG. 1 is a block diagram showing the main configuration of a scalable coding apparatus having a transform coding apparatus according to Embodiment 1 of the present invention.

The scalable coding apparatus according to this embodiment has down-sampling section 101, first layer coding section 102, multiplexing section 103, first layer decoding section 104, delaying section 105 and second layer coding section 106, and these sections carry out the following operations.

Down-sampling section 101 generates a signal of sampling rate F1 (F1≦F2) from an input signal of sampling rate F2, and outputs the signal to first layer coding section 102. First layer coding section 102 encodes the signal of sampling rate F1 outputted from down-sampling section 101. The coding parameters obtained at first layer coding section 102 are given to multiplexing section 103 and to first layer decoding section 104. First layer decoding section 104 generates a first layer decoded signal from coding parameters outputted from first layer coding section 102.

On the other hand, delaying section 105 gives a delay of a predetermined duration to the input signal. This delay is used to correct the time delay that occurs in down-sampling section 101, first layer coding section 102 and first layer decoding section 104. Using the first layer decoded signal generated at first layer decoding section 104, second layer coding section 106 carries out transform coding of the input signal that is delayed by a predetermined time and that is outputted from delaying section 105, and outputs the generated coding parameters to multiplexing section 103.

Multiplexing section 103 multiplexes the coding parameters determined in first layer coding section 102 and the coding parameters determined in second layer coding section 106, and outputs the result as final coding parameters.

Figure 2:
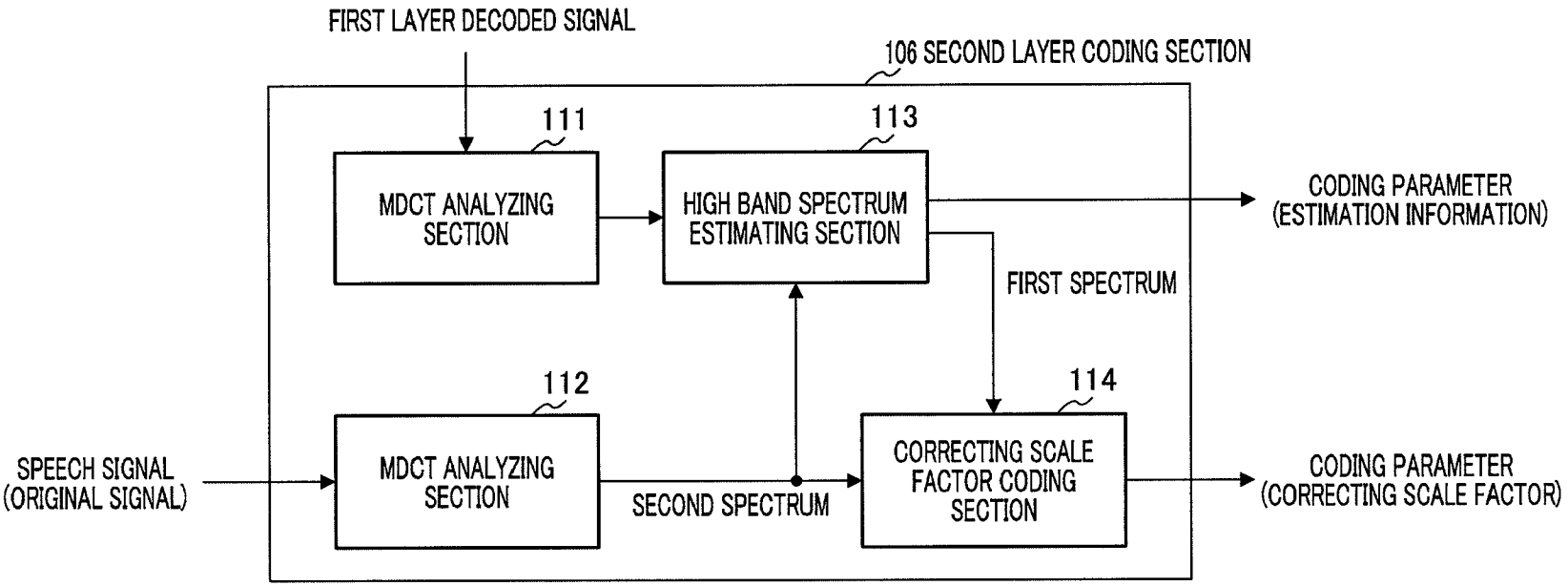
FIG. 2 is a block diagram showing the main configuration inside the second layer coding section according to Embodiment 1.

FIG. 2 is a block diagram showing the main configuration inside second layer coding section 106.

Second layer coding section 106 has MDCT analyzing sections 111 and 112, high band spectrum estimating section 113 and correcting scale factor coding section 114, and these sections carry out the following operations.

MDCT analyzing section 111 carries out an MDCT analysis of the first layer decoded signal, calculates a low band spectrum (i.e. narrow band spectrum) of a signal band (i.e. frequency band) 0 to FL, and outputs the low band spectrum to high band spectrum estimating section 113.

MDCT analyzing section 112 carries out an MDCT analysis of a speech signal, which is the original signal, calculates a wideband spectrum of a signal band 0 to FH, and outputs a high band spectrum including the same bandwidth as the narrowband spectrum and high band FL to FH as the signal band, to high band spectrum estimating section 113 and correcting scale factor coding section 114. Here, there is a relationship of FL<FH between the signal band of the narrowband spectrum and the signal band of the wideband spectrum.

High band spectrum estimating section 113 estimates the high band spectrum of the signal band FL to FH utilizing a low band spectrum of a signal band 0 to FL, and obtains an estimated spectrum. According to this method of deriving an estimated spectrum, an estimated spectrum that maximizes the similarity to the high band spectrum is determined by modifying the low band spectrum. High band spectrum estimating section 113 encodes information (i.e. estimation information) related to this estimated spectrum, outputs the obtained coding parameter and gives the estimated spectrum to correcting scale factor coding section 114.

In the following description, the estimated spectrum outputted from high band spectrum estimating section 113 will be referred to as the "first spectrum" and the high band spectrum outputted from MDCT analyzing section 112 will be referred to as the "second spectrum."

Here, the above various spectra associated with signal bands are represented as follows.

Narrowband spectrum (low band spectrum) . . . 0 to FL

Wideband spectrum . . . 0 to FH

First spectrum (estimated spectrum) . . . FL to FH

Second spectrum (high band spectrum) . . . FL to FH

Correcting scale factor coding section 114 corrects the scale factor for the first spectrum such that the scale factor for the first spectrum becomes closer to the scale factor for the second spectrum, encodes information related to this correcting scale factor and outputs the result.

Figure 3:
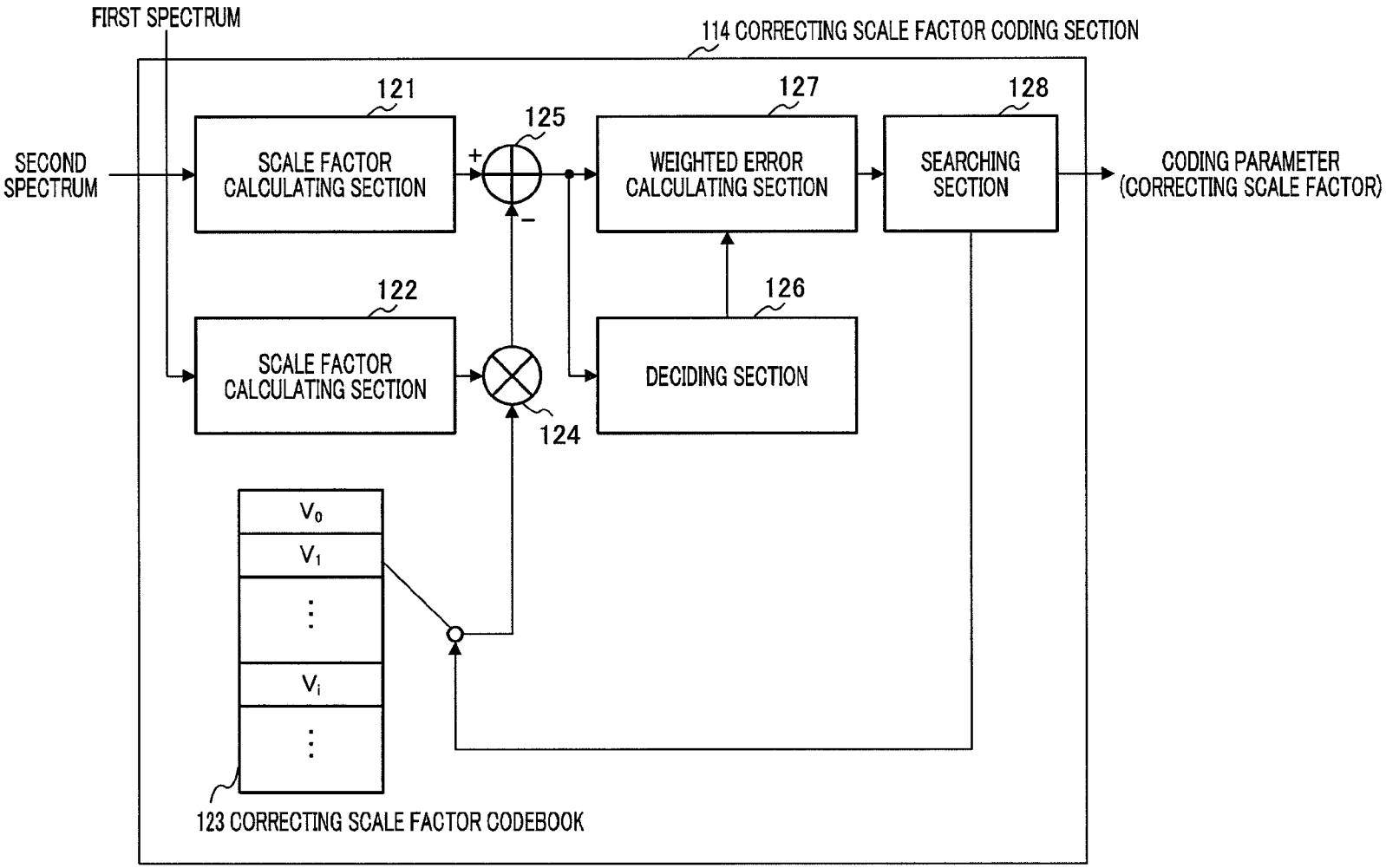
FIG. 3 is a block diagram showing the main configuration inside a correcting scale factor coding section according to Embodiment 1.

FIG. 3 is a block diagram showing the main configuration inside correcting scale factor coding section 114.

Correcting scale factor coding section 114 has scale factor calculating sections 121 and 122, correcting scale factor codebook 123, multiplier 124, subtractor 125, deciding section 126, weighted error calculating section 127 and searching section 128, and these sections carry out the following operations.

Scale factor calculating section 121 divides the signal band FL to FH of the inputted second spectrum into a plurality of subbands, finds the size of the spectrum included in each subband and outputs the result to subtractor 125. To be more specific, the signal band is divided into subbands associated with the critical bands and is divided at regular intervals according to the Bark scale. Further, scale factor calculating section 121 finds an average amplitude of the spectrum included in each subband and uses this as a second scale factor SF2 (k) {0≦k<NB}. Here, NB is the number of subbands. Further, the maximum amplitude value may be used instead of average amplitude.

Scale factor calculating section 122 divides the signal band FL to FH of the inputted first spectrum into a plurality of subbands, calculates the first scale factor SF1 (k) {0≦k<NB} of each subband and outputs the first scale factor to multiplier 124. Further, similar to scale factor calculating section 121, scale factor calculating section 122 may use the maximum amplitude value instead of average amplitude.

In subsequent processing, parameters for a plurality of subbands are combined into one vector value. For example, NB scale factors are represented by one vector. Then, a case will be described as an example where each processing is carried out on a per vector basis, that is, a case where vector quantization is carried out.

Correcting scale factor codebook 123 stores a plurality of correcting scale factor candidates and outputs one correcting scale factor from the stored correcting scale factor candidates, sequentially, to multiplier 124, according to command from searching section 128. A plurality of correcting scale factor candidates stored in correcting scale factor codebook 123 can be represented by vectors.

Multiplier 124 multiplies the first scale factor outputted from scale factor calculating section 122 by the correcting scale factor candidate outputted from correcting scale factor codebook 123, and gives the multiplication result to subtractor 125.

Subtractor 125 subtracts the output of multiplier 124, that is, the product of the first scale factor and a correcting scale factor candidate, from the second scale factor outputted from scale factor calculating section 121, and gives the resulting error signal to weighted error calculating section 127 and deciding section 126.

Deciding section 126 determines a weight vector given to weighted error calculating section 127 based on the sign of the error signal given by subtractor 125. To be more specific, the error signal d(k) outputted from subtractor 125 is represented by following equation 2.

(Equation 2)

$$d(k)=SF2(k)-v_i(k)\cdot SF1(k)\ (0\leqq k<NB) \quad [2]$$

Here, $v_i(k)$ is the i-th correcting scale factor candidate. Deciding section 126 checks the sign of d(k). When the sign is positive, deciding section 126 selects $w_{pos}$ for the weight. When the sign is negative, deciding section 126 selects $w_{neg}$ for the weight, and outputs weight vector w(k) comprised of weights, to weighted error calculating section 127. There is the relationship represented by following equation 3 between these weights.

(Equation 3)

$$0<w_{pos}<w_{neg} \quad [3]$$

For example, if the number of subbands NB is four and the sign of d(k) is {+, −, −, +}, the weight vector w(k) outputted to weighted error calculating section 127 is represented as $w(k)=\{w_{pos}, w_{neg}, w_{neg}, w_{pos}\}$ First, weighted error calculating section 127 calculates the square value of the error signal given from subtracting section 125, then calculates weighted square error E by multiplying the square value of the error signal by weight vector w(k) given from deciding section 126, and outputs the calculation result to searching section 128. Here, weighted square error E is represented by following equation 4.

(Equation 4)

$$E=\sum_{k=0}^{NB-1} w(k)\cdot d(k)^2 \quad [4]$$

Searching section 128 controls correcting scale factor codebook 123 to sequentially output the stored correcting scale factor candidates, and finds the correcting scale factor candidate that minimizes weighted square error E outputted from weighted error calculating section 127 in closed-loop processing. Searching section 128 outputs the index $i_{opt}$ of the determined correcting scale factor candidate as a coding parameter.

As described above, the weight for calculating the weighted square error according to the sign of the error signal is set, and, when the weight has the relationship represented by equation 2, the following effect can be acquired. That is, a case where error signal d(k) is positive means that a decoding value (i.e. value obtained by multiplying the first scale factor by a correcting scale factor candidate on the encoding side) that is smaller than the second scale factor, which is the target value, is generated on the decoding side. Further, a case where error signal d(k) is negative means that the decoding value that is larger than the second scale factor, which is the target value, is generated on the decoding side. Consequently, by setting the weight for when error signal d(k) is positive smaller than the weight for when error signal d(k) is negative, when the square error is substantially the same value, a correcting scale factor candidate that produces a smaller decoding value than the second scale factor is more likely to be selected.

By this means, it is possible to obtain the following improvement. For example, as in this embodiment, if a high band spectrum is estimated utilizing a low band spectrum, it is generally possible to realize lower bit rates. However, although it is possible to realize lower bit rates, the accuracy of the estimated spectrum, that is, the similarity between the estimated spectrum and the high band spectrum, is not high enough, as described above. In this case, if the decoding value of a scale factor becomes larger than the target value and the quantized scale factor works towards emphasizing the estimated spectrum, the decrease in the accuracy of the estimated spectrum becomes more perceptible to human ears as quality deterioration. By contrast with this, if the decoding value of a scale factor becomes smaller than the target value and the quantized scale factor works towards attenuating this estimated spectrum, the decrease in the accuracy of the estimated spectrum becomes less distinct, so that it is possible to acquire the effect of improving sound quality of decoded signals. Further, this tendency can be confirmed in computer simulation as well.

Figure 4:
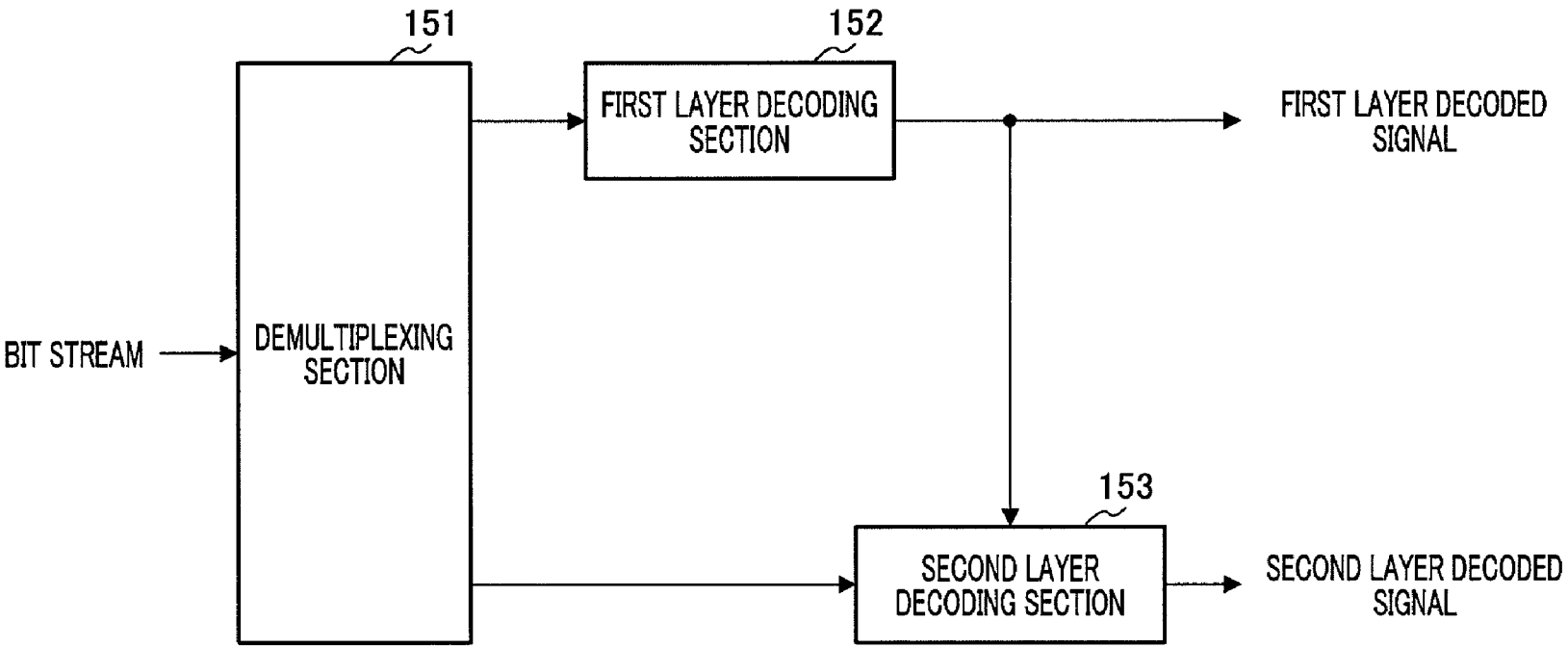
FIG. 4 is a block diagram showing the main configuration of a scalable decoding apparatus according to Embodiment 1.

Next, the scalable decoding apparatus according to this embodiment supporting the above scalable coding apparatus will be described. FIG. 4 is a block diagram showing the main configuration of this scalable decoding apparatus.

Demultiplexing section 151 separates an input bit stream representing coding parameters and generates coding parameters for first layer decoding section 152 and coding parameters for second decoding section 153.

First layer decoding section 152 decodes a decoded signal of a signal band 0 to FL using the coding parameters obtained at demultiplexing section 151 and outputs this decoded signal. Further, first layer decoding section 152 gives the obtained decoded signal to second layer decoding section 153.

The coding parameters separated at demultiplexing section 151 and the first layer decoded signal from first layer decoding section 152 are given to second layer decoding section 153. Second layer decoding section 153 decodes and converts the spectrum into a time domain signal, and generates and outputs a wideband decoded signal of a signal band 0 to FH.

Figure 5:
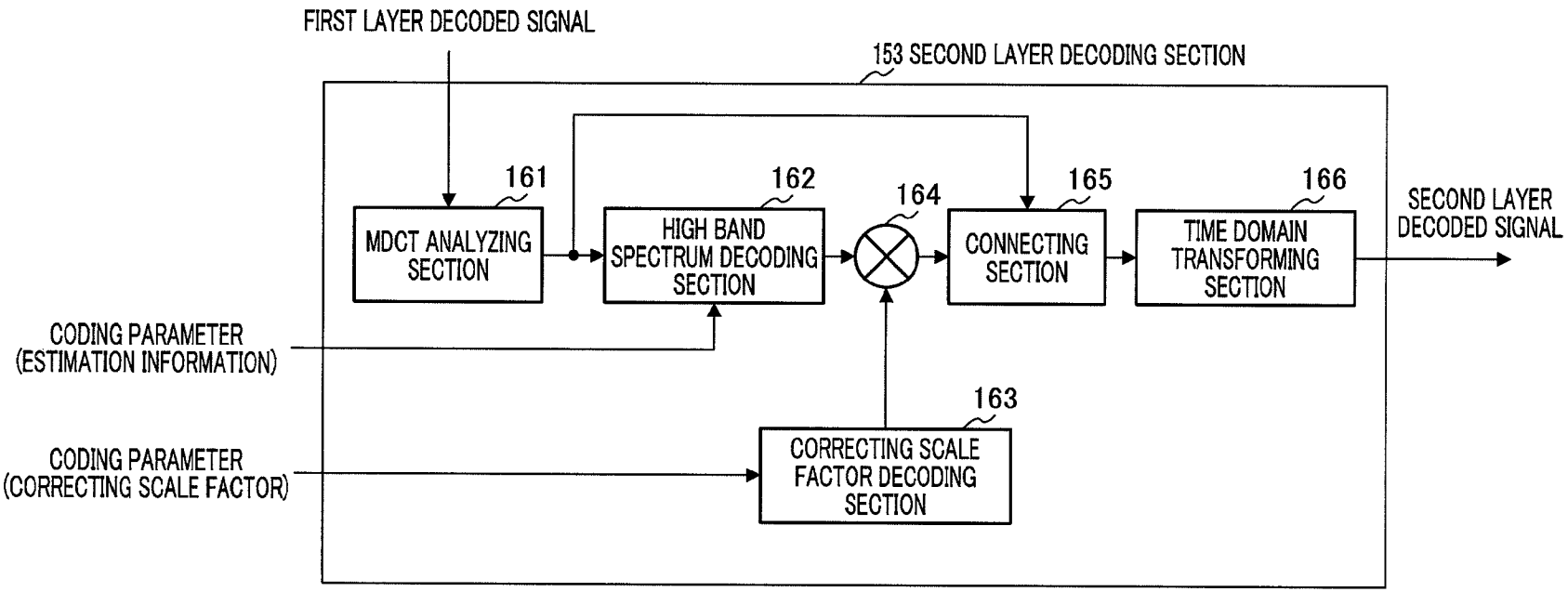
FIG. 5 is a block diagram showing the main configuration inside the second layer decoding section according to Embodiment 1.

FIG. 5 is a block diagram showing the main configuration inside second layer decoding section 153. Further, second layer decoding section 153 is a component supporting second layer coding section 106 in the transform coding apparatus according to this embodiment.

MDCT analyzing section 161 carries out an MDCT analysis of the first layer decoded signal, calculates the first spectrum of the signal band 0 to FL, and then outputs the first spectrum to high band spectrum decoding section 162.

High band spectrum decoding section 162 decodes an estimated spectrum (i.e. fine spectrum) of a signal band FL to FH using coding parameters (i.e. estimation information) transmitted from the transform coding apparatus according to this embodiment and the first spectrum. The obtained estimated spectrum is given to multiplier 164.

Correcting scale factor decoding section 163 decodes a correcting scale factor using a coding parameter (i.e. correcting scale factor) transmitted from the transform coding apparatus according to this embodiment. To be more specific, correcting scale factor decoding section 163 refers to a built-in correcting scale factor codebook (not shown) and outputs an applicable correcting scale factor to multiplier 164.

Multiplier 164 multiplies the estimated spectrum outputted from high band spectrum decoding section 162 by the correcting scale factor outputted from correcting scale factor decoding section 163, and outputs the multiplication result to connecting section 165.

Connecting section 165 connects in the frequency domain the first spectrum with the estimated spectrum outputted from multiplier 164, generates a wideband decoded spectrum of a signal band 0 to FH and outputs the wideband decoded spectrum to time domain transforming section 166.

Time domain transforming section 166 carries out inverse MDCT processing of the decoded spectrum outputted from connecting section 165, multiplies the decoded signal by an adequate window function, and then adds the corresponding domains of the decoded signal and the signal of the previous frame after windowing, and generates and outputs a second layer decoded signal.

As described above, according to this embodiment, in frequency domain encoding of a high layer, when scale factors are quantized by converting an input signal to frequency domain coefficients, the scale factors are quantized using weighted distortion measures that make quantization candidates that decrease the scale factors more likely to be selected. That is, the quantization candidate that makes scale factors after quantization smaller than scale factors before quantization are more likely to be selected. Therefore, when the number of bits allocated to quantization of scale factors is insufficient, it is possible to reduce deterioration of subjective quality.

Further, according to the technique disclosed in Non-Patent Document 2, if Bark scale i is the same, weight function $w_i$ represented by above equation 1 is the same at all times. However, according to this embodiment, even if Bark scale i is the same, the weight multiplied upon the difference $(E_i-C_i(m))$ between an input signal and quantization candidate is changed according to the difference. That is, the weight is set such that quantization candidate $C_i(m)$, which makes $E_i-C_i(m)$ positive, is more likely to be selected than quantization candidate $C_i(m)$, which makes $E_i-C_i(m)$ negative. In other words, the weight is set such that the quantized scale factors are smaller than original scale factors.

Further, although a case has been described with this embodiment where vector quantization is used, processing may be carried out separately per subband instead of carrying out vector quantization, that is, instead of carrying out processing per vector. In this case, for example, the correcting scale factor candidates included in the correcting scale factor codebook are represented by scalars.

Embodiment 2

The basic configuration of the scalable coding apparatus that has the transform coding apparatus according to Embodiment 2 of the present invention is the same as in Embodiment 1. For this reason, repetition of description will be omitted here, and second layer coding section 206, which has a different configuration from Embodiment 1, will be described below.

Figure 6:
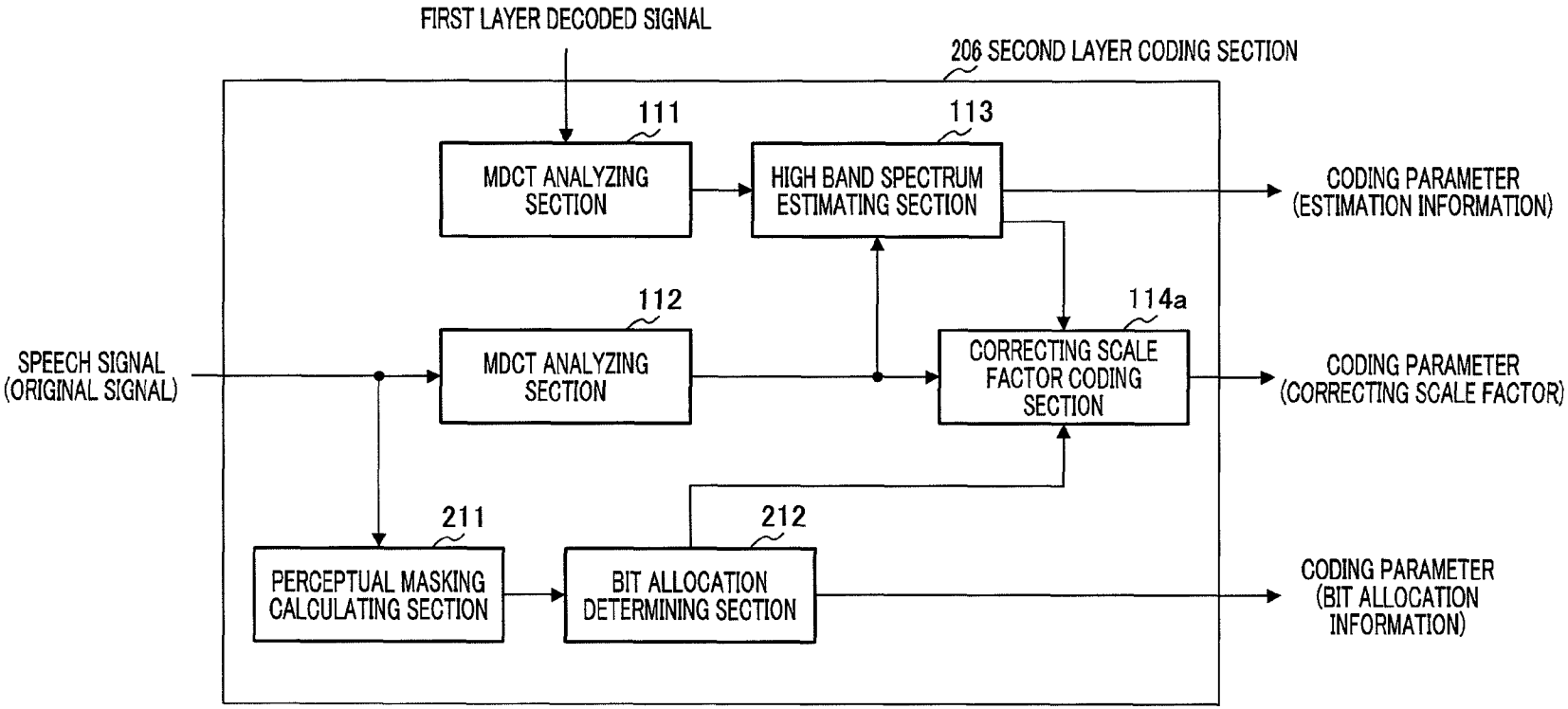
FIG. 6 is a block diagram showing the main configuration inside the second layer coding section according to Embodiment 2.

FIG. 6 is a block diagram showing the main configuration inside second layer coding section 206. Second layer coding section 206 has the same basic configuration as second layer coding section 106 described in Embodiment 1, and so the same components will be assigned the same reference numerals and repetition of description will be omitted. Further, the basic operation is the same, but components having differences in details will be assigned the same reference numerals with small alphabet letters and will be described as appropriate. Furthermore, when other components are described, the same representation will be employed.

Second layer coding section 206 further has perceptual masking calculating section 211 and bit allocation determining section 212, and correcting scale factor coding section 114*a* encodes correcting scale factors based on the bit allocation determined in bit allocation determining section 212.

To be more specific, perceptual masking calculating section 211 analyzes an input signal, calculates an perceptual masking value showing a permitted value of quantization distortion and outputs this value to bit allocation determining section 212.

Bit allocation section 212 determines to which subbands bits are allocated to what extent, based on the perceptual masking value calculated at perceptual masking calculating section 211, and outputs this bit allocation information to outside and to correcting scale factor coding section 114*a*.

Correcting scale factor coding section 114*a* quantizes a correcting scale factor candidate using the number of bits determined based on the bit allocation information outputted from bit allocation determining section 212, and outputs its index as a coding parameter, and sets the magnitude of weight for the subband based on the number of quantized bits of the correcting scale factor. To be more specific, correcting scale factor coding section 114*a* sets the magnitude of weight to increase the difference between two weights for the correcting scale factor for a subband with a small number of quantization bits, that is, the difference between weight $w_{pos}$ for when error signal d(k) is positive and weight $w_{neg}$ for when error signal d(k) is negative. On the other hand, for the above two weights for a subband with a large number of quantization bits, correcting scale factor coding section 114*a* sets the magnitude of weight to decrease the difference between these two weights.

By employing the above configuration, the quantization candidate which makes scale factors after quantization smaller than scale factors before quantization are more likely to be selected for the correcting scale factor for the subbands with a smaller number of quantization bits, so that it is possible to reduce perceptual quality deterioration.

Next, the scalable decoding apparatus according to this embodiment will be described. However, the scalable decoding apparatus according to this embodiment has the same basic configuration as the scalable coding apparatus described in Embodiment 1, and so second layer decoding section 253, which has a different configuration from Embodiment 1, will be described later.

Figure 7:
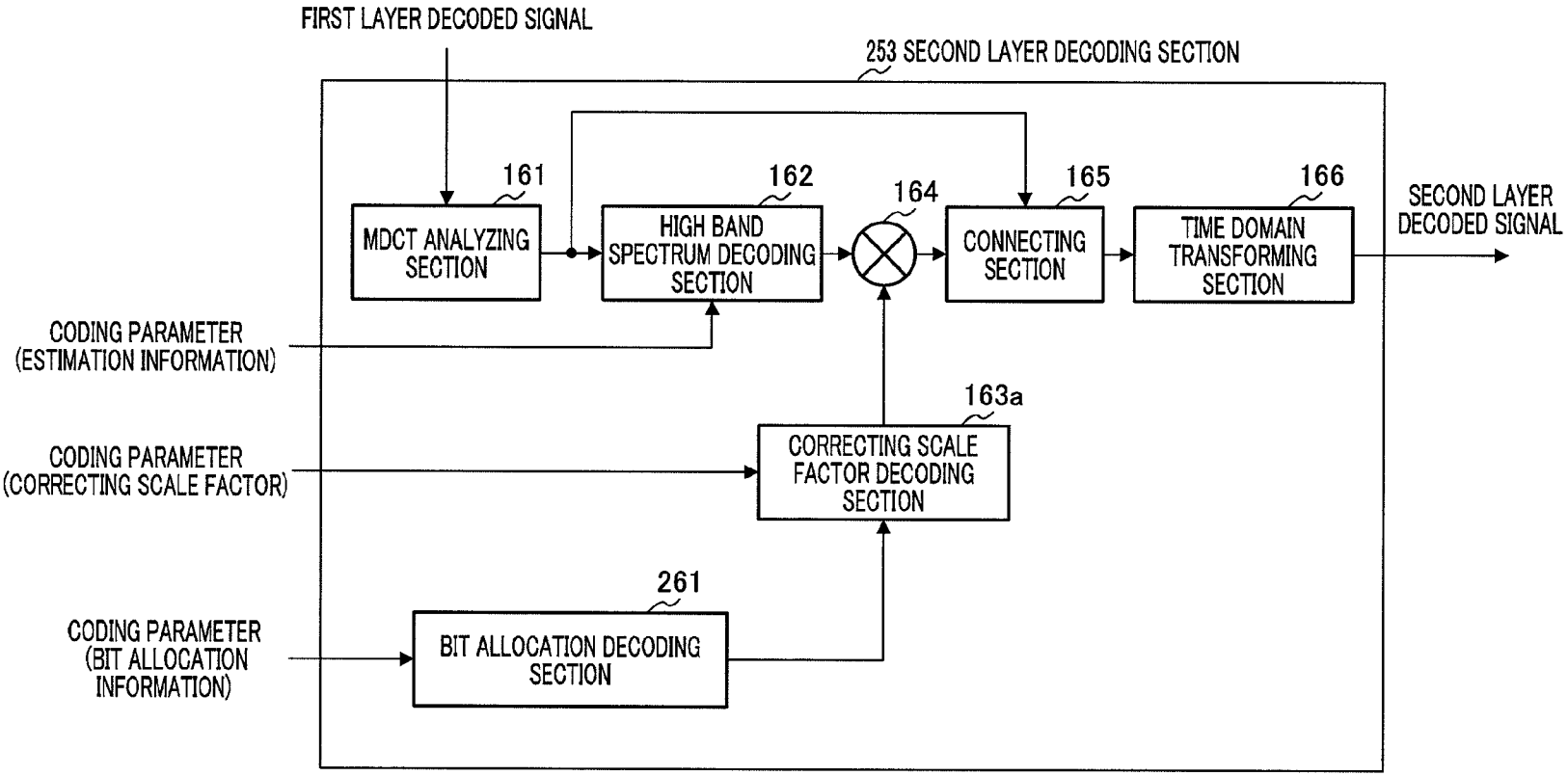
FIG. 7 is a block diagram showing the main configuration inside the second layer decoding section according to Embodiment 2.

FIG. 7 is a block diagram showing the main configuration inside second layer decoding section 253.

Bit allocation decoding section 261 decodes the number of bits of each subband using coding parameters (i.e. bit allocation information) transmitted from the scalable coding apparatus according to this embodiment, and outputs the obtained number of bits to correcting scale factor decoding section 163*a*.

Correcting scale factor decoding section 163*a* decodes a correcting scale factor using the number of bits of each subband and the coding parameters (i.e. correcting scale factors), and outputs the obtained correcting scale factor to multiplier 164. The other processings are the same as in Embodiment 1.

In this way, according to this embodiment, weight is changed according to the number of quantized bits allocated to the scale factor for each band. This weight change is carried out such that when the number of bits allocated to the subband is small, the difference between weight $w_{pos}$ for when error signal d(k) is positive and weight $w_{neg}$ for when error signal d(k) is negative increases.

By employing the above configuration, the quantization candidate which makes scale factors smaller after quantization than scale factors before quantization are more likely to be selected for the scale factors with a small number of quantization bits, so that it is possible to reduce perceptual quality deterioration produced in the band.

Embodiment 3

The basic configuration of the scalable coding apparatus that has the transform coding apparatus according to Embodiment 3 of the present invention is the same as in Embodiment 1. For this reason, repetition of description will be omitted and second layer coding section 306 that has a different configuration from Embodiment 1 will be described.

Figure 8:
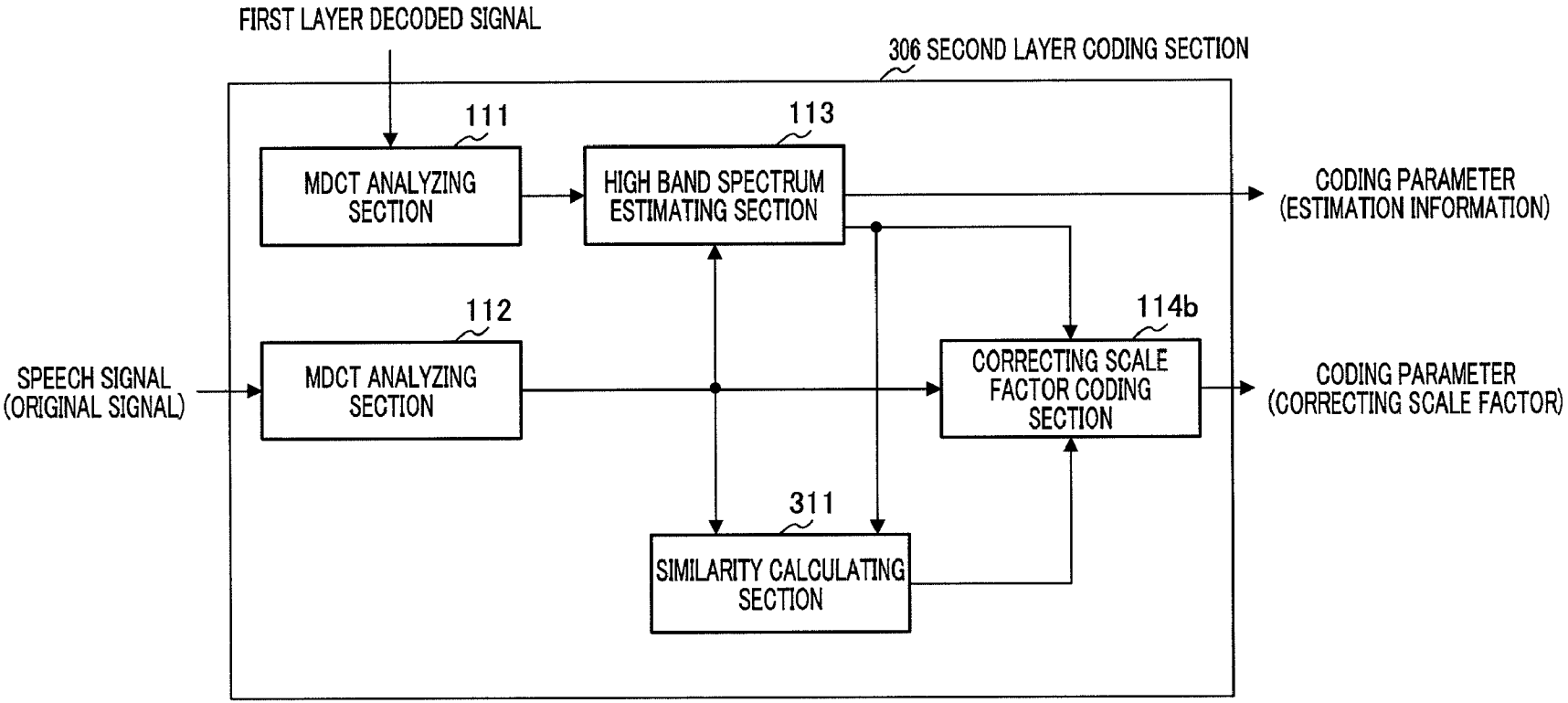
FIG. 8 is a block diagram showing the main configuration inside the second layer coding section according to Embodiment 3.

The basic operation of second layer coding section 306 is similar to the operation of second layer coding section 206 described in Embodiment 2 and differs in using the similarity, described later, instead of bit allocation information used in Embodiment 2. FIG. 8 is a block diagram showing the main configuration inside second layer coding section 306.

Similarity calculating section 311 calculates the similarity between a second spectrum of a signal band FL to FH, that is, the spectrum of the original signal and an estimated spectrum of a signal band FL to FH, and outputs the obtained similarity to correcting scale factor coding section 114*b*. Here, the similarity is defined by, for example, the SNR (Signal-to-Noise Ratio) of the estimated spectrum to the second spectrum.

Correcting scale factor coding section 114*b* quantizes a correcting scale factor candidate based on the similarity outputted from similarity calculating section 311, outputs its index as a coding parameter, and sets the magnitude of weight for the subband based on the similarity of the subband. To be more specific, correcting scale factor coding section 114*b* sets the magnitude of weight to increase the difference between two weights for the correcting scale factor for the subbands with a low similarity, that is, the difference between weight $w_{pos}$ for when error signal d(k) is positive and weight $w_{neg}$ for when error signal d(k) is negative. On the other hand, for the above two weights for the correcting scale factor for subbands with a high similarity, correcting scale factor coding section 114*b* sets the magnitude of weight to decrease the difference between these two weights.

The basic configurations of the scalable decoding apparatus and transform decoding apparatus according to this embodiment are the same as in Embodiment 1, and so repetition of description will be omitted.

In this way, according to this embodiment, weight is changed according to the accuracy (for example, similarity and SNR) of the shape of the estimated spectrum of each band with respect to the spectrum of the original signal. This weight change is carried out such that when the similarity of the subband is small, the difference between weight $w_{pos}$ for when error signal d(k) is positive and weight $w_{neg}$ for when error signal d(k) is negative increases.

By employing the above configuration, the quantization candidate which makes scale factors after quantization smaller than scale factors before quantization are more likely to be selected for the scale factors supporting the subbands with a low SNR of the estimated spectrum, so that it is possible to reduce perceptual quality deterioration produced in the band.

Embodiment 4

Cases have been described with Embodiments 1 to 3 as examples where an input of correcting scale factor coding sections 114, 114*a* and 114*b* is two spectra of different characteristics, the first spectrum and the second spectrum. However, according to the present invention, an input of correcting scale factor coding sections 114, 114*a* and 114*b* may be one spectrum. The embodiment of this case will be described below.

According to Embodiment 4 of the present invention, the present invention is applied to a case where the number of layers is one, that is, a case where scalable coding is not carried out.

Figure 9:
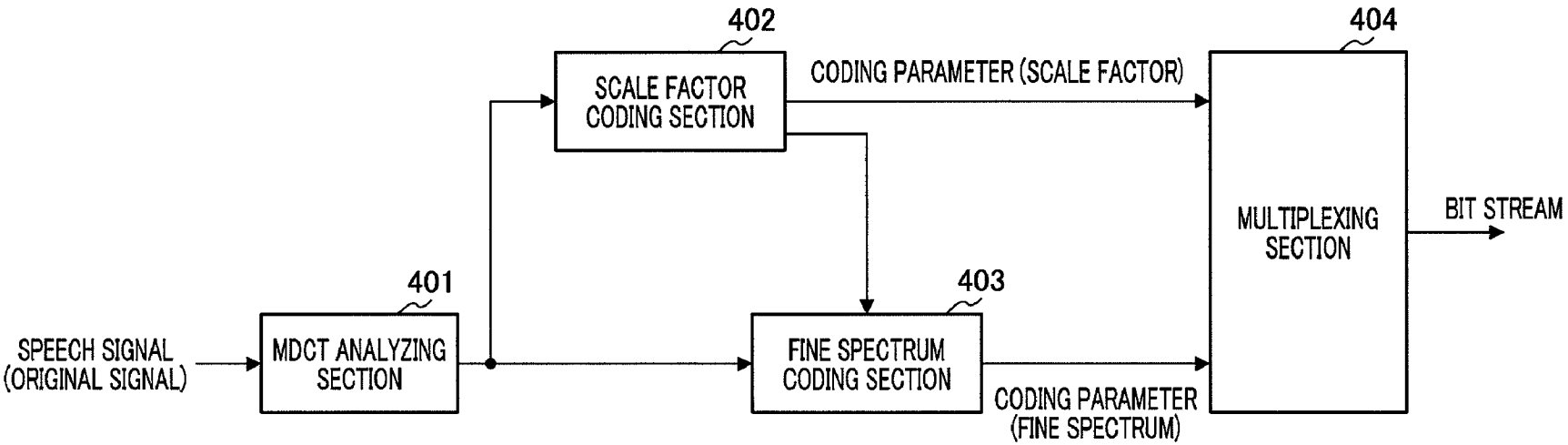
FIG. 9 is a block diagram showing the main configuration of the transform coding apparatus according to Embodiment 4.

FIG. 9 is a block diagram showing the main configuration of the transform coding apparatus according to this embodiment. Further, a case will be described here as an example where MDCT is used as the transform scheme.

The transform coding apparatus according to this embodiment has MDCT analyzing section 401, scalable factor coding section 402, fine spectrum coding section 403 and multiplexing section 404, and these sections carry out the following operations.

MDCT analyzing section 401 carries out an MDCT analysis of a speech signal, which is the original signal, and outputs the obtained spectrum to scale factor coding section 402 and fine spectrum coding section 403.

Scale factor coding section 402 divides the signal band of the spectrum determined in MDCT analyzing section 401 into a plurality of subbands, calculates the scale factor for each subband and quantizes these scale factors. Details of this quantization will be described later. Scale factor coding section 402 outputs coding parameters (i.e. scale factor) obtained by quantization to multiplexing section 404 and outputs to decoded scale factor as is to fine spectrum coding section 403.

Fine spectrum coding section 403 normalizes the spectrum given from MDCT analyzing section 401 using the decoded scale factor outputted from scale factor coding section 402 and encodes the normalized spectrum. Fine spectrum coding section 403 outputs the obtained coding parameters (i.e. fine spectrum) to multiplexing section 404.

Figure 10:
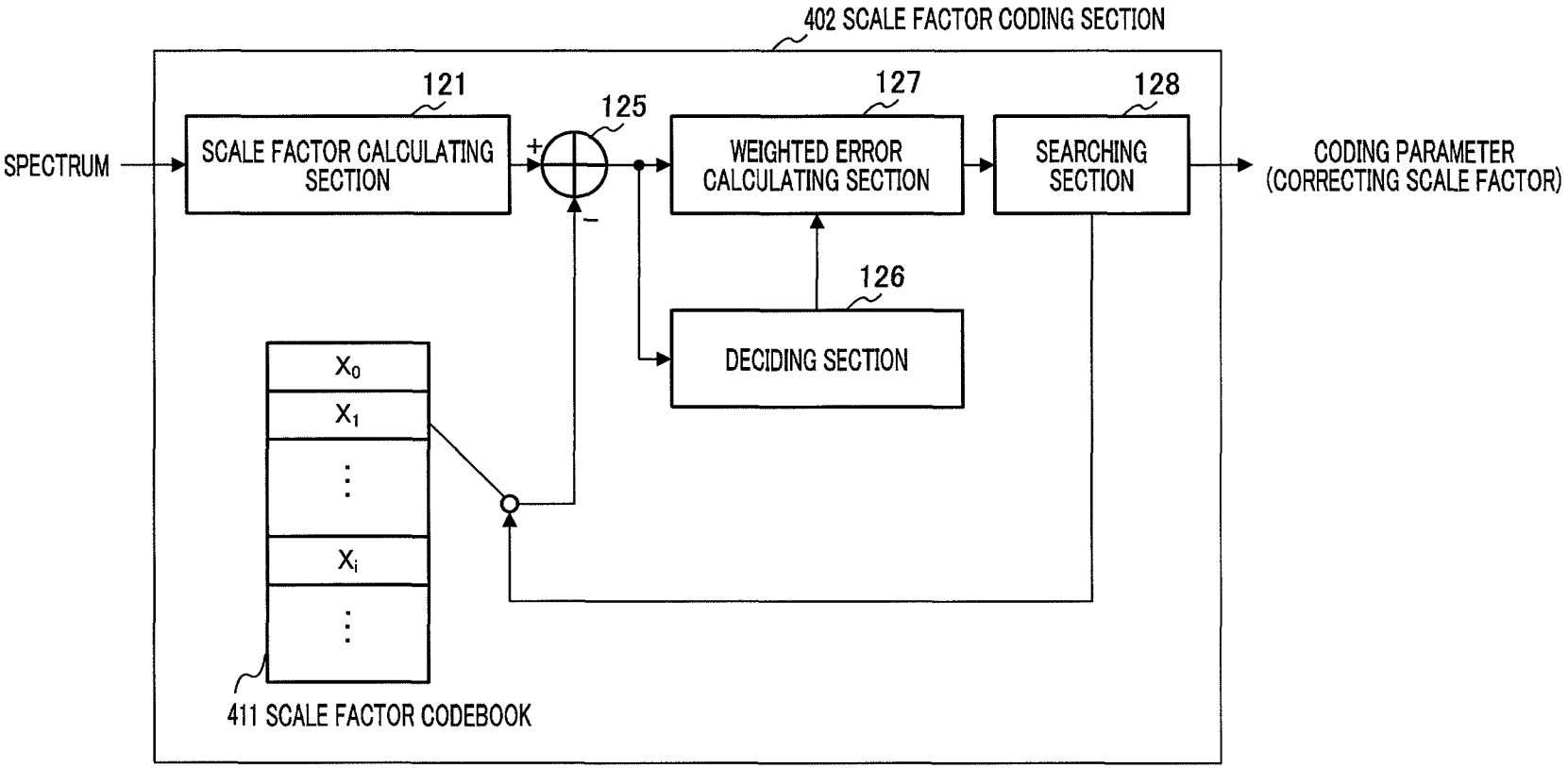
FIG. 10 is a block diagram showing the main configuration inside the scale factor coding section according to Embodiment 4.

FIG. 10 is a block diagram showing the main configuration inside scale factor coding section 402. Further, this scale factor coding section 402 has the same basic configuration as scale factor coding section 114 described in Embodiment 1, and so the same components will be assigned the same reference numerals and repetition of description will be omitted.

Although, in Embodiment 1, multiplier 124 multiplies scale factor SF1(k) for the first spectrum by correcting scale factor candidate $v_i(k)$ and subtractor 125 finds error signal d(k), this embodiment differs in outputting scale factor candidate $x_i(k)$ directly to subtractor 125 and finding error signal d(k). That is, in this embodiment, equation 2 described in Embodiment 1 is represented as follows.

(Equation 5)

$$d(k)=SF2(k)-x_i(k)\ (0\leqq k<NB) \quad [5]$$

Figure 11:
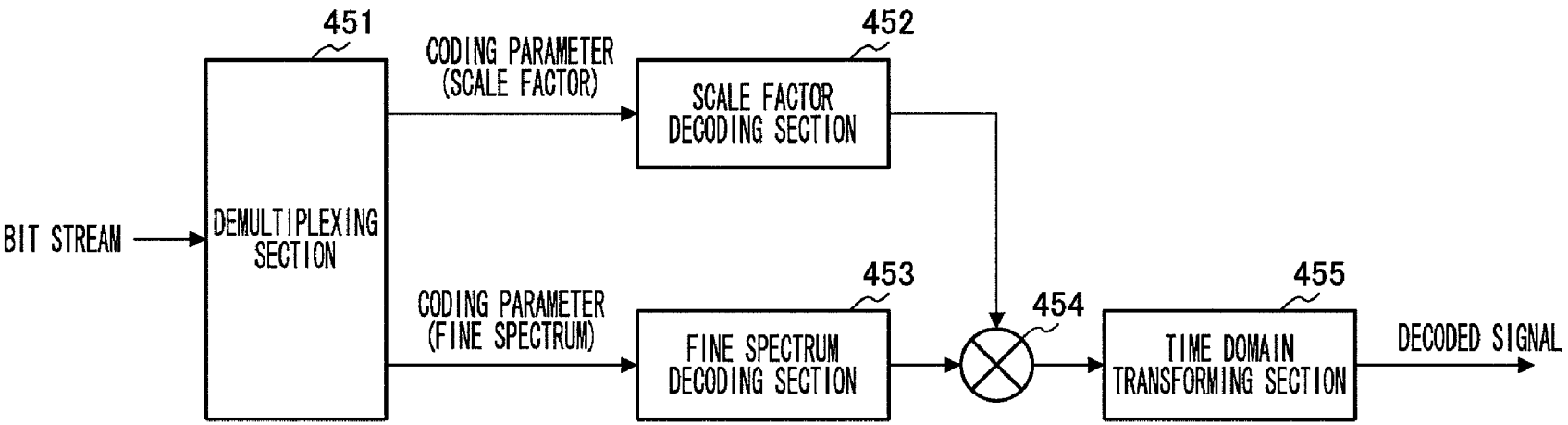
FIG. 11 is a block diagram showing the main configuration of the transform decoding apparatus according to Embodiment 4.

FIG. 11 is a block diagram showing the main configuration of the transform decoding apparatus according to this embodiment.

Demultiplexing section 451 separates an input bit stream representing coding parameters and generates coding parameters (i.e. scale factor) for scale factor decoding section 452 and coding parameters (i.e. fine spectrum) for fine spectrum decoding section 453.

Scale factor decoding section 452 decodes the scale factor using the coding parameters (i.e. scale factor) obtained at demultiplexing section 451 and outputs the scale factor to multiplier 454.

Fine spectrum decoding section 453 decodes the fine spectrum using the coding parameters (i.e. fine spectrum) obtained at demultiplexing section 451 and outputs the fine spectrum to multiplier 454.

Multiplier 454 multiplies the fine spectrum outputted from fine spectrum decoding section 453 by the scale factor outputted from scale factor decoding section 452 and generates a decoded spectrum. This decoded spectrum is outputted to time domain transforming section 455.

Time domain transforming section 455 carries out time domain conversion of the decoded spectrum outputted from multiplier 454 and outputs the obtained time domain signal as the final decoded signal.

In this way, according to this embodiment, the present invention can be applied to single layer coding.

Further, scale factor coding section 402 may have a configuration for attenuating in advance scale factors for the spectrum given from MDCT analyzing section 401 according to indices such as the bit allocation information described in Embodiment 2 and the similarity described in Embodiment 3, and then carrying out quantization according to a normal distortion measure without weighting. By this means, it is possible to reduce speech quality deterioration under a low bit rate environment.

Embodiment 5

Figure 12:
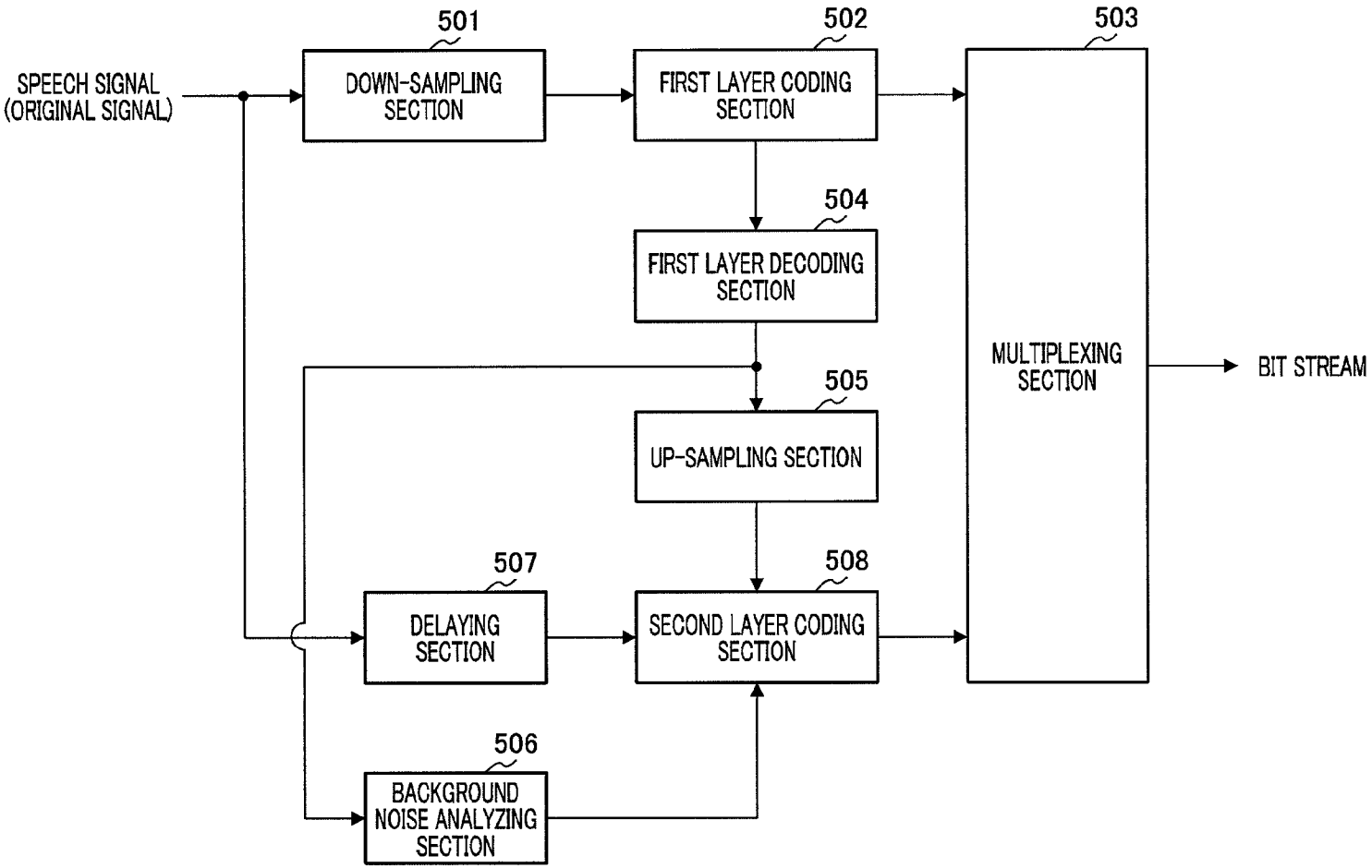
FIG. 12 is a block diagram showing the main configuration of the scalable coding apparatus according to Embodiment 5.

FIG. 12 is a block diagram showing the main configuration of the scalable coding apparatus that has the transform coding apparatus according to Embodiment 5 of the present invention.

The scalable coding apparatus according to Embodiment 5 of the present invention is mainly formed with down-sampling section 501, first layer coding section 502, multiplexing section 503, first layer decoding section 504, up-sampling section 505, delaying section 507, second layer coding section 508 and background noise analyzing section 506.

Down-sampling section 501 generates a signal of sampling rate F1 (F1≦F2) from an input signal of sampling rate F2 and gives the signal to first layer coding section 502. First layer coding section 502 encodes the signal of sampling rate F1 outputted from down-sampling section 501. The coding parameters obtained at first layer coding section 502 is given to multiplexing section 503 and to first layer decoding section 504. First layer decoding section 504 generates a first layer decoded signal from the coding parameters outputted from first layer coding section 502 and outputs this signal to background noise analyzing section 506 and up-sampling section 505. Up-sampling section 505 changes the sampling rate for the first layer decoded signal from F1 to F2 and outputs the first layer decoded signal of sampling rate F2 to second layer coding section 508.

Background noise analyzing section 506 receives the first layer decoded signal and decides whether or not the signal contains background noise. If background noise analyzing section 506 decides that background noise is contained in the first layer decoded signals, background noise analyzing section 506 analyzes the frequency characteristics of background noise by carrying out, for example, MDCT processing of the background noise and outputs the analyzed frequency characteristics as background noise information to second layer coding section 508. On the other hand, if background noise analyzing section 506 decides that background noise is not contained in the first layer decoded signal, background noise analyzing section 506 outputs background noise information showing that the background noise is not contained in the first layer decoded signal, to second layer coding section 508. Further, as a background noise detection method, this embodiment can employ a method of analyzing input signals of a certain period, calculating the maximum power value and the minimum power value of the input signals and using the minimum power value as noise when the ratio of the maximum power value to the minimum value or the difference between the maximum power value and minimum power value is equal to or greater than a threshold, as well as other general background noise detection methods.

Delaying section 507 adds a delay of a predetermined duration to the input signal. This delay is used to correct the time delay that occurs in down-sampling section 501, first layer coding section 502 and first layer decoding section 504.

Second layer coding section 508 carries out transform coding of the input signal that is delayed by a predetermined time and that is outputted from delaying section 507, using the up-sampled first layer decoded signal obtained from up-sampling section 505 and background information obtained from background noise analyzing section 506, and outputs the generated coding parameters to multiplexing section 503.

Multiplexing section 503 multiplexes the coding parameters determined at first layer coding section 502 and the coding parameters determined at second layer coding section 508 and outputs the result as the definitive coding parameters.

Figure 13:
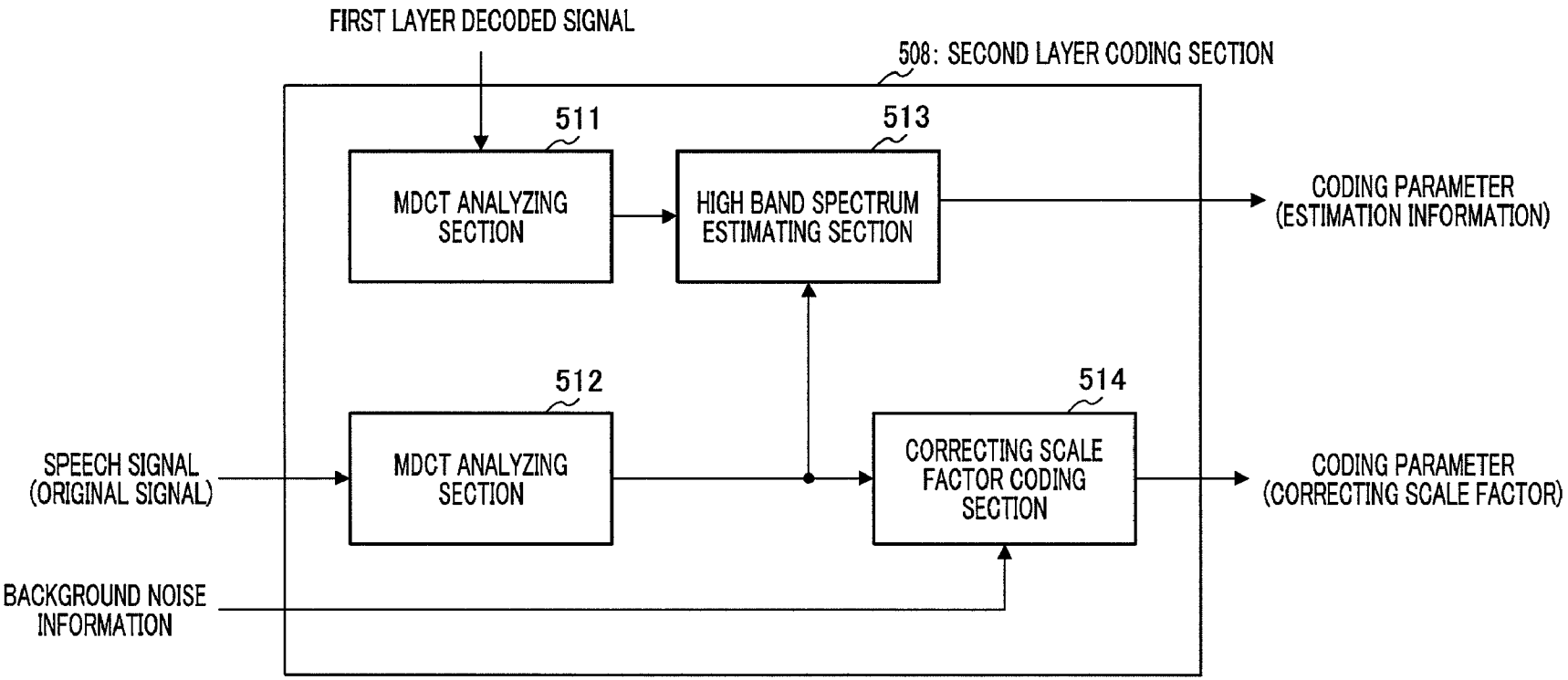
FIG. 13 is a block diagram showing the main configuration inside the second layer coding section according to Embodiment 5.

FIG. 13 is a block diagram showing the main configuration inside second layer coding section 508. Second layer coding section 508 has MDCT analyzing sections 511 and 512, high band spectrum estimating section 513 and correcting scale factor coding section 514, and these sections carry out the following operations.

MDCT analyzing section 511 carries out an MDCT analysis of the first layer decoded signals, calculates a low band spectrum (i.e. narrow band spectrum) of a signal band (i.e. frequency band) 0 to FL and outputs the low band spectrum to high band spectrum estimating section 513.

MDCT analyzing section 512 carries out an MDCT analysis of a speech signal, which is the original signal, calculates a wideband spectrum of a signal band 0 to FH and outputs a high band spectrum including the same bandwidth as the narrowband spectrum and the high band FL to FH as the signal band, to high band spectrum estimating section 513 and correcting scale factor coding section 514. Here, there is a relationship of FL<FH between the signal band of the narrowband spectrum and the signal band of the wideband spectrum.

High band spectrum estimating section 513 estimates the high band spectrum of the signal band FL to FH utilizing a low band spectrum of a signal band 0 to FL, and obtains an estimated spectrum. According to this method of deriving an estimated spectrum, an estimated spectrum that maximizes the similarity to the high band spectrum is determined by modifying the low band spectrum. High band spectrum estimating section 513 encodes information (i.e. estimation information) related to the estimated spectrum, and outputs the obtained coding parameters.

In the following description, the estimated spectrum outputted from high band spectrum estimating section 513 will be referred to as the "first spectrum," and the high band spectrum outputted from MDCT analyzing section 512 will be referred to as the "second spectrum."

Here, the above various spectra associated with signal bands are represented as follows.

Narrowband spectrum (low band spectrum) . . . 0 to FL
Wideband spectrum . . . 0 to FH
First spectrum (estimated spectrum) . . . FL to FH
Second spectrum (high band spectrum) . . . FL to FH Correcting scale factor coding section 514 encodes and outputs information related to scale factor for the second spectrum using background noise information.

Figure 14:
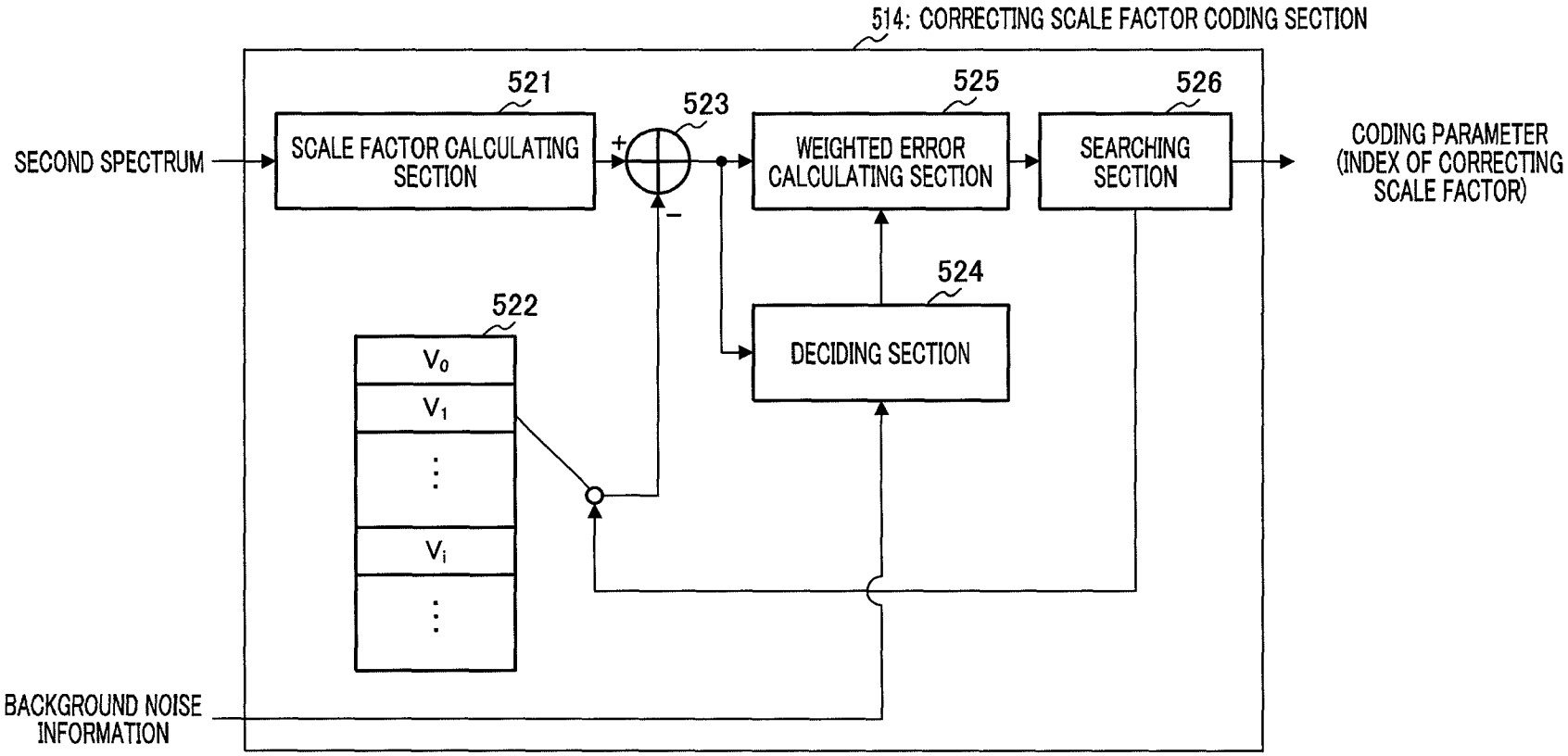
FIG. 14 is a block diagram showing the main configuration inside the correcting scale factor coding section according to Embodiment 5.

FIG. 14 is a block diagram showing the main configuration inside correcting scale factor coding section 514. Correcting scale factor coding section 514 has scale factor calculating section 521, correcting scale factor codebook 522, subtractor 523, deciding section 524, weighted error calculating section 525 and searching section 526, and these sections carry out the following operations.

Scale factor calculating section 521 divides the signal band FL to FH of the inputted second spectrum into a plurality of subbands, finds the size of the spectrum included in each subband and outputs the result to subtractor 523. To be more specific, the signal band is divided into the subbands associated with the critical bands and is divided regular intervals according to the Bark scale. Further, scale factor calculating section 521 finds an average amplitude of the spectrum included in each subband and uses this as a second scale factor SF2 (k) {0≦k<NB}. Here, NB is the number of subbands. Further, the maximum amplitude value may be used instead of average amplitude.

In subsequent processing, parameters for a plurality of subbands are combined into one vector value. For example, NB scale factors are represented by one vector. Then, a case will be described as an example where each processing is carried out on a per vector basis, that is, a case where vector quantization is carried out.

Correcting scale factor codebook 522 stores in advance a plurality of correcting scale factor candidates and outputs one correcting scale factor from the stored correcting scale factor candidates, sequentially, to subtractor 523, according to command from searching section 526. A plurality of correcting scale factor candidates stored in correcting scale factor codebook 522 can be represented by vectors.

Subtractor 523 subtracts the correcting scale factor candidate, which is the output of the correcting scale factor, from the second scale factor outputted from scale factor calculating section 521, and outputs the resulting error signal to weighted error calculating section 525 and deciding section 524.

Deciding section 524 determines a weight vector given to weighted error calculating section 525 based on the sign of the error signal given from subtractor and background noise information. Hereinafter, flows of detailed processings in deciding section 524 will be described.

Deciding section 524 analyzes inputted background noise information. Further, deciding section 524 includes background noise flag BNF(k){0≦k<NB} where the number of elements equals the number of subbands NB. When background noise information shows that the input signal (i.e. first decoded signal) does not contain background noise, deciding section 524 sets all values of background noise flag BNF(k) to zero. Further, when background noise information shows that the input signal (i.e. first decoded signal) contains background noise, deciding section 524 analyzes the frequency characteristics of background noise shown in background noise information and converts the frequency characteristics of background noise into frequency characteristics of each subband. Further, for ease of description, background noise information is assumed to show the average power value of each subband. Deciding section 524 compares average power value SP(k) of the spectrum of each subband with threshold ST(k) of each subband set inside in advance, and, when SP(k) is ST(k) or greater, the value of background noise flag BNF(k) of the applicable subband is set to one.

Here, error signal d(k) given from the subtractor is represented by following equation 6.

(Equation 6)

$$d(k)=SF2(k)-v_i(k)\ (0\leqq k<NB) \quad [6]$$

Here, $v_i(k)$ is the i-th correcting scale factor candidate. If the sign of d(k) is positive, deciding section 524 selects $w_{pos}$ for the weight. Further, if the sign of d(k) is negative and the value of BNF(k) is one, deciding section 524 selects $w_{pos}$ for the weight. Further, if the sign of d(k) is negative and the value of background noise flag BNF(k) is zero, deciding section 524 selects $w_{neg}$ for the weight. Next, deciding section 524 outputs weight vector w(k) comprised of the weights to weighted error calculating section 525. There is the relationship represented by following equation 7 between these weights.

(Equation 7)

$$0<w_{pos}<w_{neg} \quad [7]$$

For example, if the number of subbands NB is four, the sign of d(k) is {+, −, −, +} and background noise flag BNF(k) is {0, 0, 1, 1}, the weight vector w(k) outputted to weighted error calculating section 525 is represented as $w(k)=\{w_{pos}, w_{neg}, w_{pos}, w_{pos}\}$.

First, weighted error calculating section 525 calculates the square value of the error signal given from subtractor 523, then calculates weighted square error E by multiplying the square values of the error signal by weight vector w(k) given from deciding section 524 and outputs the calculation result to searching section 526. Here, weighted square error E is represented by following equation 8.

(Equation 8)

$$E=\sum_{k=0}^{NB-1} w(k)\cdot d(k)^2 \quad [8]$$

Searching section 526 controls correcting scale factor codebook 522 to sequentially output the stored correcting scale factor candidates, and finds the correcting scale factor candidate that minimizes weighted square error E outputted from weighted error calculating section 525 in closed-loop processing. Searching section 526 outputs the index $i_{opt}$ of the determined correcting scale factor candidate as the coding parameter.

As described above, the weight for calculating the weighted square error according to the sign of the error signal is set, and, when the weight has the relationship represented by equation 7, the following effect can be acquired. That is, a case where error signal d(k) is positive means that a decoding value (i.e. value obtained by normalizing the first scale factor and multiplying the normalized value by a correcting scale factor candidate on the encoding side) that is smaller than the second scale factor, which is the target value, is generated on the decoding side. Further, a case where error signal d(k) is negative means that the decoding value that is larger than the second scale factor, which is the target value, is generated on the decoding side. Consequently, by setting the weight for when error signal d(k) is positive smaller than the weight for when error signal d(k) is negative, when the square error is substantially the same value, a correcting scale factor candidate that produces a smaller decoding value than the second scale factor is more likely to be selected.

By this means, it is possible to obtain the following improvement. For example, as in this embodiment, if a high band spectrum is estimated utilizing a low band spectrum, it is generally possible to realize lower bit rates. However, although it is possible to realize lower bit rates, the accuracy of the estimated spectrum, that is, the similarity between the estimated spectrum and the high band spectrum, is not high enough, as described above. In this case, if the decoding value of a scale factor becomes larger than the target value and the quantized scale factor works towards emphasizing the estimated spectrum, the decrease in the accuracy of the estimated spectrum becomes more perceptible to human ears as quality deterioration. By contrast with this, if the decoding values of a scale factors becomes smaller than the target value and the quantized scale factor works towards attenuating this estimated spectrum, the decrease in the accuracy of the estimated spectrum becomes less distinct, so that it is possible to obtain the effect of improving sound quality of decoded signals. Further, by adjusting the degree of the above effect according to whether or not the input signal (i.e. first layer decoded signals) contains background noise, it is possible to obtain decoded signals with perceptual quality. Further, this tendency can be confirmed in computer simulation as well.

Next, the scalable decoding apparatus according to this embodiment supporting the above scalable coding apparatus will be described. Further, the configuration of the scalable decoding apparatus is the same as in FIG. 4 described in Embodiment 1, and so repetition of description will be omitted.

Figure 15:
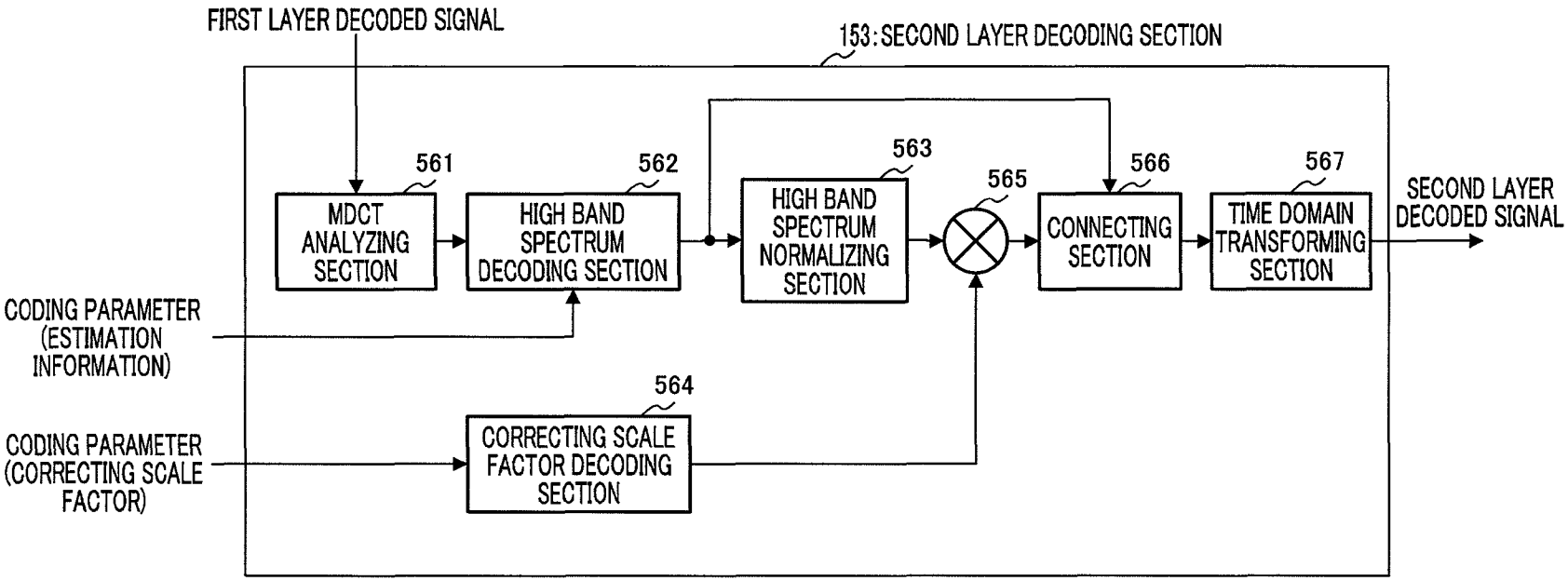
FIG. 15 is a block diagram showing the main configuration inside the second layer decoding section according to Embodiment 5.

Only the configuration inside second layer decoding section 153 of the decoding apparatus according to this embodiment is different from Embodiment 1. Hereinafter, the main configuration of second layer decoding section 153 according to this embodiment will be described with reference to FIG. 15. Further, second layer decoding section 153 is the component supporting second layer coding section 508 in the transform coding apparatus according to this embodiment.

MDCT analyzing section 561 carries out an MDCT analysis of the first layer decoded signal, calculates the first spectrum of the signal band 0 to FL, and then outputs the first spectrum to high band spectrum decoding section 562.

High band spectrum decoding section 562 decodes an estimated spectrum (i.e. fine spectrum) of a signal band FL to FH using the coding parameters (i.e. estimation information) transmitted from the transform coding apparatus according to this embodiment and the first spectrum. The obtained estimated spectrum is given to high band spectrum normalizing section 563.

Correcting scale factor decoding section 564 decodes a correcting scale factor using a coding parameter (i.e. correcting scale factor) transmitted from the transform coding apparatus according to this embodiment. To be more specific, correcting scale factor decoding section 564 refers to correcting scale factor codebook 522 (not shown) set inside and outputs an applicable correcting scale factor to multiplier 565.

High band spectrum normalizing section 563 divides the signal band FL to FH of the estimated spectrum outputted from high band spectrum decoding section 562, into a plurality of subbands and finds the size of spectrum included in each subband. To be more specific, the signal band is divided into the subbands associated with the critical bands and is divided at regular intervals according to the Bark scale. Further, scale factor calculating section 521 finds an average amplitude of the spectrum included in each subband and uses this as a first scale factors SF1 (k) $\{0 \leqq k < NB\}$. Here, NB is the number of subbands. Further, the maximum amplitude value may be used instead of average amplitude. Next, high band spectrum normalizing section 563 divides an estimated spectrum value (i.e. MDCT value) by a first scale factor SF1 (k) of the subband and outputs the divided estimated spectrum value to multiplier 565 as the normalized estimated spectrum.

Multiplier 565 multiplies the normalized estimated spectrum outputted from high band spectrum normalizing section 563 by the correcting scale factor outputted from correcting scale factor decoding section 564 and outputs the multiplication result to connecting section 566.

Connecting section 566 connects in the frequency domain the first spectrum with the normalized estimated spectrum outputted from the multiplier, generates a wideband decoded spectrum of a signal band 0 to FH and outputs the wideband decoded spectrum to time domain transforming section 166.

Time domain transforming section 567 carries out inverse MDCT processing of the decoded spectrum outputted from connecting section 566, multiplies the decoded spectrum by an adequate window function, and then adds corresponding domains of the decoded spectrum and the signal of the previous frame after windowing, generates and outputs a second layer decoded signal.

As described above, according to this embodiment, in frequency domain encoding of a high layer, when scale factors are quantized by converting an input signal to frequency domain coefficients, the scale factors are quantized using weighted distortion measures that make quantization candidates that decrease the scale factors more likely to be selected. That is, the quantization candidate that makes scale factors after quantization smaller than scale factors before quantization are more likely to be selected. Therefore, when the number of bits allocated to quantization of the scale factors is insufficient, it is possible to reduce deterioration of subjective quality.

Further, although a case has been described with this embodiment where vector quantization is used, processing may be carried out separately per subband instead of carrying out vector quantization, that is, instead of carrying out processing per vector. In this case, for example, the correcting scale factor candidates included in the correcting scale factor codebook 522 are represented by scalars.

Further, with this embodiment, although the value of background noise flag BNF(k) is determined by comparing the average power value of each subband with a threshold, the present invention is not limited to this, and is applied in the same way to the method of utilizing the ratio of the average power value of background noise in each subband to the average power value of the first decoded signal (i.e. speech part).

Further, with this embodiment, although a configuration of the coding apparatus having up-sampling section 505 inside has been described, the present invention is not limited to this, and can be applied in the same way to a case where narrowband first layer decoded signals are inputted to the second layer coding section.

Further, although a case has been described with this embodiment where quantization is carried out at all times according to the above method irrespective of input signal characteristics (for example, part including speech or part not including speech), the present invention is not limited to this, and can be applied in the same way to a case where whether or not to utilize the above method is switched according to input signal characteristics (for example, voiced part or unvoiced part). For example, a method of carrying out vector quantization with respect to part where speech is included in the input signal according to distance calculation applying the above weight, and carrying out vector quantization according to the methods described in Embodiments 1 to 4 with respect to part where speech is not included in the input signal may be possible instead of carrying out vector quantization according to the distance calculation applying the above weight. In this way, by switching in the time domain the distance calculation methods for vector quantization according to the input signal characteristics, it is possible to obtain decoded signals with better quality.

Embodiment 6

Figure 16:
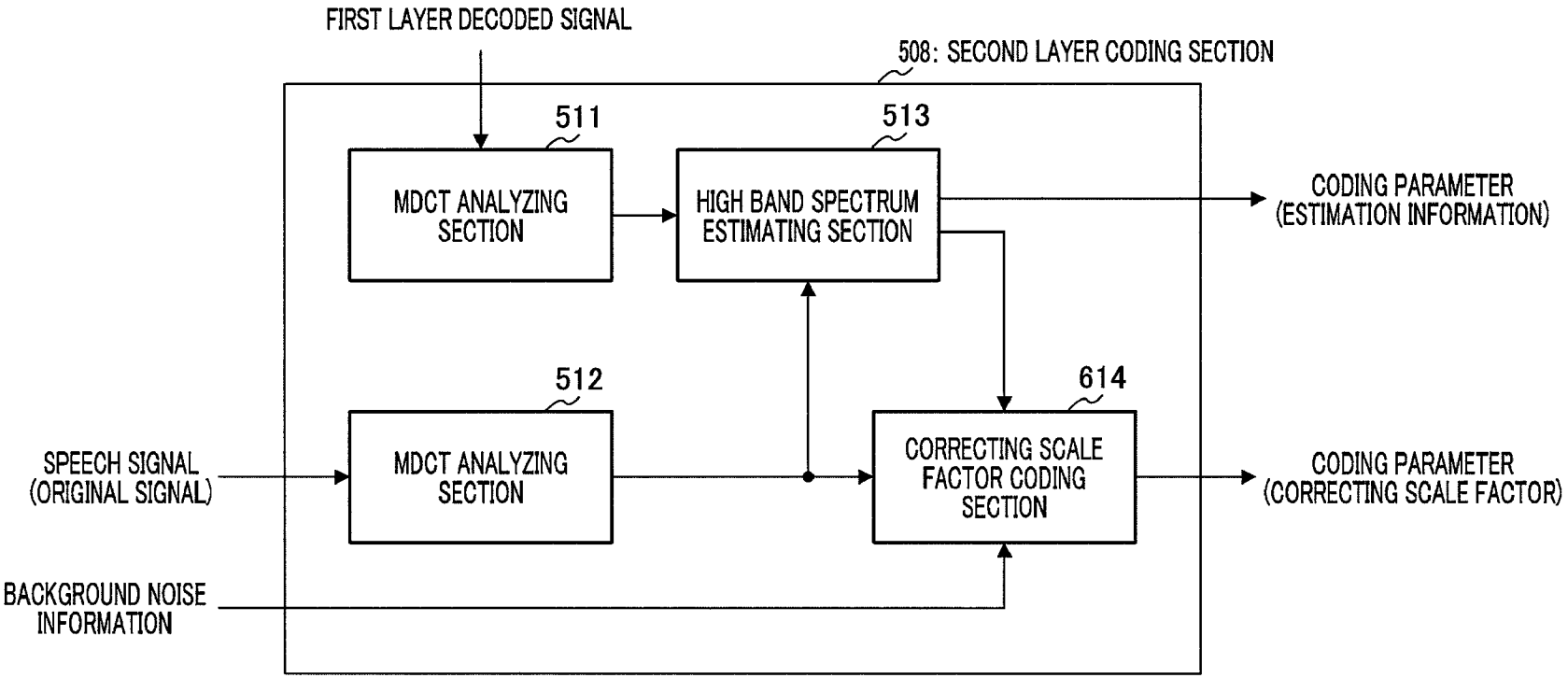
FIG. 16 is a block diagram showing the main configuration inside the second layer coding section according to Embodiment 6.

Embodiment 6 of the present invention differs from Embodiment 5 in the configuration inside the second layer coding section of the coding apparatus. FIG. 16 is a block diagram showing the main configuration inside second layer coding section 508 according to this embodiment. Compared to FIG. 13, in second layer coding section 508 shown in FIG. 16, the effect of correcting scale factor coding section 614 is different from correcting scale factor coding section 514.

High band spectrum estimating section 513 gives the estimated spectrum as is to correcting scale factor coding section 614.

Correcting scale factor coding section 614 corrects scale factor for the first spectrum using background noise information such that the scale factor for the first spectrum becomes closer to scale factor for the second spectrum, encodes information related to this correcting scale factors and outputs the result.

Figure 17:
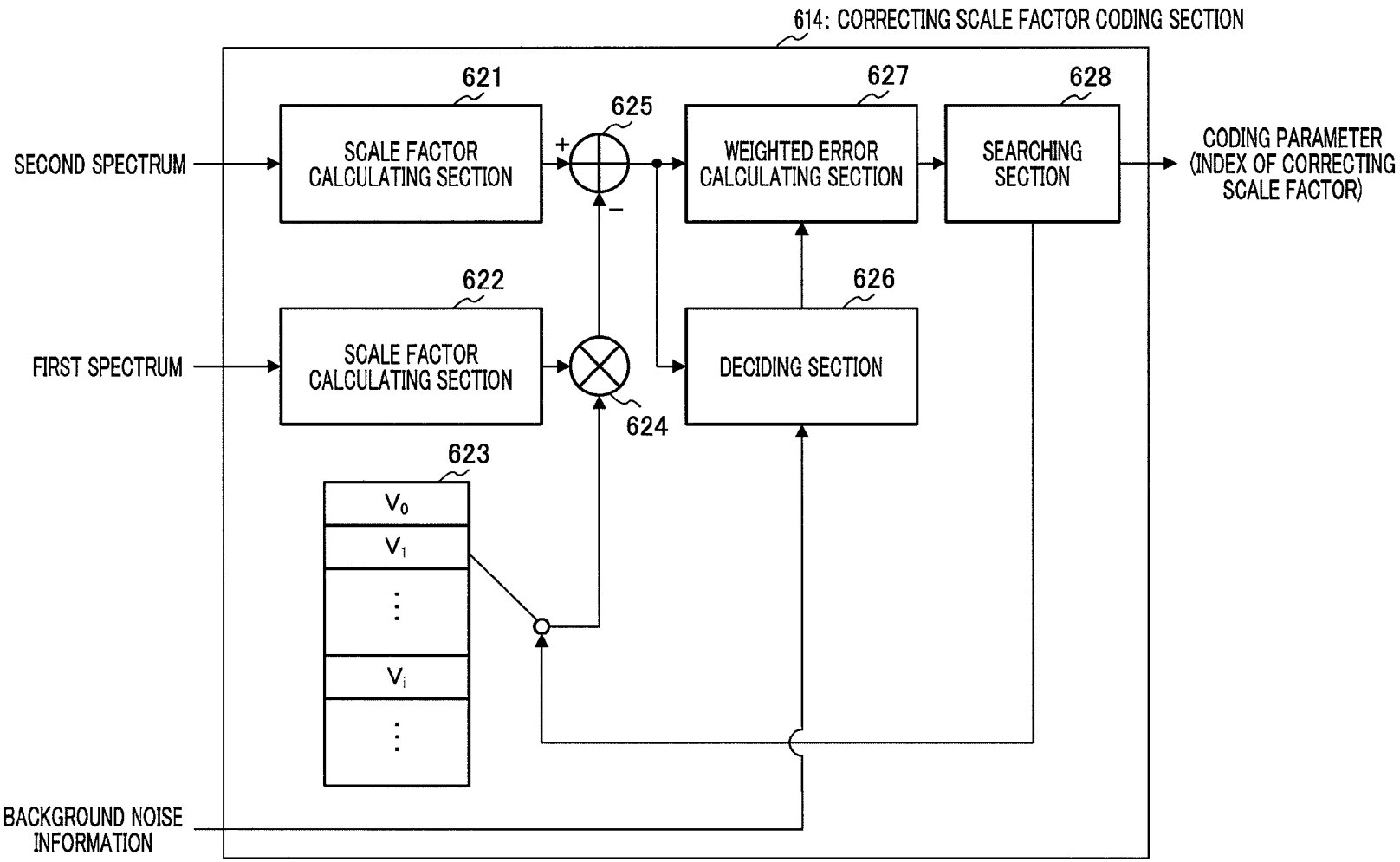
FIG. 17 is a block diagram showing the main configuration inside the correcting scale factor coding section according to Embodiment 6.

FIG. 17 is a block diagram showing the main configuration inside correcting scale factor coding section 614 in FIG. 16. Correcting scale factor coding section 614 has scale factor calculating sections 621 and 622, correcting scale factor codebook 623, multiplier 624, subtractor 625, deciding section 626, weighted error calculating section 627 and searching section 628, and these sections carry out the following operations.

Scale factor calculating section 621 divides the signal band FL to FH of the inputted second spectrum into a plurality of subbands, finds the size of the spectrum included in each subband and outputs the result to subtractor 625. To be more specific, the signal band is divided into the subbands associated with the critical bands and is divided at regular intervals according to the Bark scale. Further, scale factor calculating section 621 finds an average amplitude of the spectrum included in each subband and uses this as a second scale factor SF2(k){0≦k<NB}. Here, NB is the number of subbands. Further, the maximum amplitude value may be used instead of average amplitude.

In subsequent processing, parameters for a plurality of subbands are combined into one vector value. For example, NB scale factors are represented by one vector. Then, a case will be described as an example where each processing is carried out on a per vector basis, that is, a case where vector quantization is carried out.

Scale factor calculating section 622 divides the signal band FL to FH of the inputted first spectrum into a plurality of subbands, calculates the first scale factor SF1 (k){0≦k<NB} of each subband and outputs the first scale factor to multiplier 624. The maximum amplitude value may be used instead of average amplitude similar to scale factor calculating section 621.

Correcting scale factor codebook 623 stores in advance a plurality of correcting scale factor candidates and outputs one correcting scale factor from the stored correcting scale factor candidates, sequentially, to multiplier 624, according to command from searching section 628. A plurality of correcting scale factor candidates stored in correcting scale factor codebook 623 can be represented by vectors.

Multiplier 624 multiplies the first scale factor outputted from scale factor calculating section 622 by the correcting scale factor candidate outputted from correcting scale factor codebook 623, and gives the multiplication result to subtractor 125.

Subtractor 625 subtracts the output of multiplier 624, that is, the product of the first scale factor and a correcting scale factor candidate, from the second scale factor outputted from scale factor calculating section 621, and gives the resulting error signal to deciding section 626 and weighted error calculating section 627.

Deciding section 626 determines a weight vector given to weighted error calculating section based on the sign of the error signal and background noise information given by subtractor 625. Hereinafter, flows of detailed processings in deciding section 626 will be described.

Deciding section 626 analyzes inputted background noise information. Further, deciding section 626 includes background noise flag BNF(k){0≦k<NB} where the number of elements equals the number of subbands NB. When background noise information shows that the input signal (i.e. first decoded signal) does not contain background noise, deciding section 626 sets all values of background noise flag BNF(k) to zero. Further, when background noise information shows that the input signal (i.e. first decoded signal) contains background noise, deciding section 626 analyzes the frequency characteristics of background noise shown in background noise information and converts the frequency characteristics of background noise into frequency characteristics of each subband. Further, for ease of description, background noise information is assumed to show the average power value of each subband. Deciding section 626 compares average power value SP(k) of the spectrum of each subband with threshold ST(k) of each subband set inside in advance, and, when SP(k) is ST(k) or greater, the values of background noise flag BNF (k) of the applicable subband is set to one.

Here, error signal d(k) given from the subtractor 625 is represented by following equation 9.

(Equation 9)

$$d(k)=SF2(k)-v_i(k)\cdot SF1(k)\ (0\leqq k<NB) \quad [9]$$

Here, $v_i(k)$ is the i-th correcting scale factor candidate. If the sign of d(k) is positive, deciding section 626 selects $w_{pos}$ for the weight. Further, if the sign of d(k) is negative and the value of BNF(k) is one, deciding section 626 selects $w_{pos}$ for the weight. Further, if the sign of d(k) is negative and the value of background noise flag BNF(k) is zero, deciding section 626 selects $w_{neg}$ for the weight. Next, deciding section 626 outputs weight vector w(k) comprised of the weights to weighted error calculating section 627. There is the relationship represented by following equation 10 between these weights.

(Equation 10)

$$0<w_{pos}<w_{neg} \quad [10]$$

For example, if the number of subbands NB is four, the sign of d(k) is {+, −, −, +} and background noise flag BNF(k) is {0, 0, 1, 1}, the weight vector w(k) outputted to weighted error calculating section 627 is represented as w(k)={$w_{pos}$, $w_{neg}$, $w_{pos}$, $w_{pos}$}.

First, weighted error calculating section 627 calculates the square value of the error signal given from subtractor 625, then calculates weighted square error E by multiplying the square value of the error signal by weight vector w(k) given from deciding section 626 and outputs the calculation result to searching section 628. Here, weighted square error E is represented by following equation 11.

(Equation 11)

$$E=\sum_{k=0}^{NB-1} w(k)\cdot d(k)^2 \quad [11]$$

Searching section 628 controls correcting scale factor codebook 623 to sequentially output the stored correcting scale factor candidates, and finds the correcting scale factor candidate that minimizes weighted square error E outputted from weighted error calculating section 627 in closed-loop processing. Searching section 628 outputs the index $i_{opt}$ of the determined correcting scale factor candidate as the coding parameters.

As described above, the weight for calculating the weighted square errors according to the sign of the error signal is set, and, when the weight has the relationship represented by equation 10, the following effect can be acquired. That is, a case where error signal d(k) is positive means that a decoding value (i.e. value obtained by normalizing the first scale factor and multiplying the normalized value by the correcting scale factor candidate on the encoding side) that is smaller than the second scale factor, which is the target value, is generated on the decoding side. Further, a case where error signal d(k) is negative means that the decoding value that is larger than the second scale factor, which is the target value, is generated on the decoding side. Consequently, by setting the weight for when error signal d(k) is positive smaller than the weight for when error signal d(k) is negative, when the square errors is substantially the same value, the correcting scale factor candidate that produces a smaller decoding value than the second scale factor is more likely to be selected.

By this means, it is possible to obtain the following improvement. For example, as in this embodiment, if a high band spectrum is estimated utilizing a low band spectrum, it is generally possible to realize lower bit rates. However, although it is possible to realize lower bit rates, the accuracy of the estimated spectrum, that is, the similarity between the estimated spectrum and the high band spectrum, is not high enough, as described above. In this case, if the decoding value of a scale factor becomes larger than the target value and the quantized scale factor works towards emphasizing the estimated spectrum, the decrease in the accuracy of the estimated spectrum becomes more perceptible to human ears as quality deterioration. By contrast with this, if the decoding value of a scale factor becomes smaller than the target value and the quantized scale factor works towards attenuating this estimated spectrum, the decrease in the accuracy of the estimated spectrum becomes less distinct, so that it is possible to obtain the effect of improving sound quality of decoded signals. Further, by adjusting the degree of the above effect according to whether or not the input signal (i.e. first layer decoded signal) contains background noise, it is possible to obtain decoded signals with perceptual quality. Further, this tendency can be confirmed in computer simulation.

Further, although a case has been described with this embodiment where quantization is carried out at all times according to the above method irrespective of input signal characteristics (for example, part including speech or part not including speech), the present invention is not limited to this, and can be applied in the same way to a case where whether or not to utilize the above method is switched according to input signal characteristics (for example, voiced part or unvoiced part). For example, a method of carrying out vector quantization with respect to part where speech is included in the input signal according to distance calculation applying the above weight, and carrying out vector quantization according to the methods described in Embodiments 1 to 4 with respect to part where speech is not included in the input signals may be possible instead of carrying out vector quantization according to the distance calculation applying the above weight. In this way, by switching in the time domain the distance calculation methods for vector quantization according to the input signal characteristics, it is possible to obtain decoded signals with better quality.

Embodiment 7

Figure 18:
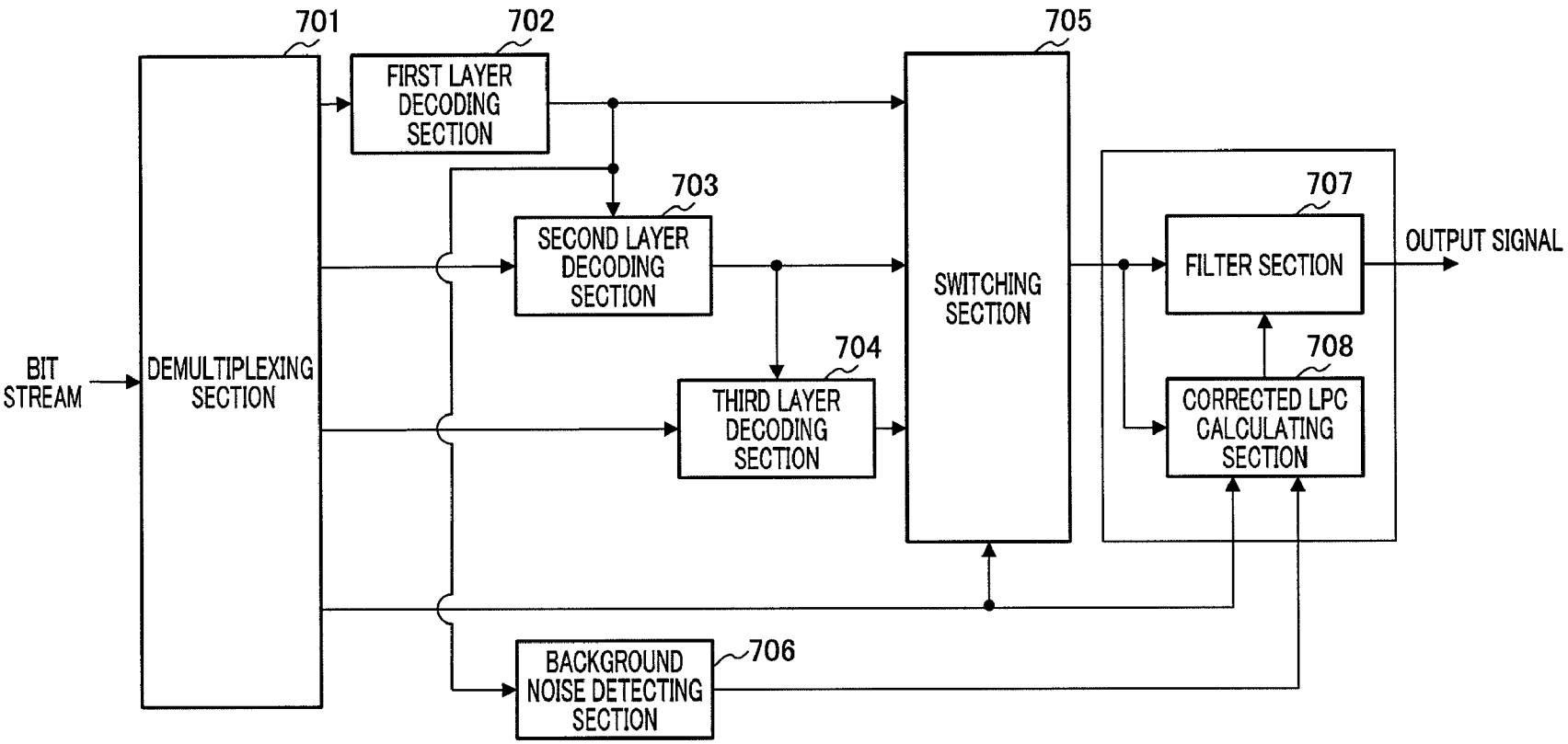
FIG. 18 is a block diagram showing the main configuration of the scaleable decoding apparatus according to Embodiment 7.

FIG. 18 is a block diagram showing the main configuration of the scalable decoding apparatus according to Embodiment 7 of the present invention. In FIG. 18, demultiplexing section 701 receives a bit stream transmitted from the coding apparatus (not shown), separates the bit stream based on layer information recorded in the received bit stream and outputs layer information to switching section 705 and corrected LPC calculating section of a post filter.

When layer information shows layer 3, that is, when encoding information of all layers (the first layer to third layer) is included in the bit stream, demultiplexing section 701 separates the first layer encoding information, the second layer encoding information and the third encoding information from the bit stream. The separated first layer encoding information, the second layer encoding information and the third layer encoding information are outputted to first layer decoding section 702, second layer decoding section 703 and third layer encoding section 704, respectively.

Further, when layer information shows layer 2, that is, when encoding information of the first layer and the second layer is included in the bit stream, demultiplexing section 701 separates the first layer encoding information and the second layer encoding information from the bit stream. The separated first layer encoding information and second layer encoding information are outputted to first layer decoding section 702 and second layer decoding section 703, respectively.

When layer information shows layer 1, that is, when only encoding information of the first layer is included in the bit stream, demultiplexing section 701 separates the first layer encoding information from the bit stream and outputs the first layer encoding information to first layer decoding section 702.

First layer decoding section 702 generates first layer decoded signals of standard quality where signal band k is 0 or greater and less than FH, using the first layer encoding information outputted from demultiplexing section 701, and outputs the generated first layer decoded signals to switching section 705, second layer decoding section 703 and background noise detecting section 706.

When demultiplexing section 701 outputs the second layer encoding information, second layer decoding section 703 generates second layer decoded signals of improved quality where signal band k is 0 or greater and less than FL and second layer decoded signals of standard quality where signal band k is FL or greater and less than FH, using this second layer encoding information and the first layer decoded signals outputted from first layer decoding section 702. The generated second layer decoded signals are outputted to switching section 705 and third layer decoding section 704. Further, when the layer information shows layer 1, the second layer encoding information cannot be obtained, and so second layer decoding section 703 does not operate at all or updates variables provided in second layer decoding section 703.

When demultiplexing section 701 outputs the third layer encoding information, third layer decoding section 704 generates third layer decoded signals of improved quality where signal band k is 0 or greater and less than FH, using the third layer encoding information and the second layer decoded signals outputted from second layer decoding section 703. The generated third layer decoded signals are outputted to switching section 705. Further, when the layer information shows layer 1 or layer 2, the second layer encoding information cannot be obtained, and so third layer decoding section 704 does not operate at all or updates variables provided in third layer decoding section 704.

Background noise detecting section 706 receives the first layer decoded signals and decides whether or not these signals contain background noise. If background noise analyzing section 506 decides that background noise is contained in the first layer decoded signals, background noise analyzing section 706 analyzes the frequency characteristics of background noise by carrying out, for example, MDCT processing of the background noise and outputs the analyzed frequency characteristics as background noise information to second layer coding section 708. Further, if background noise analyzing section 506 decides that background noise is not contained in the first layer decoded signal, background noise analyzing section 706 outputs background noise information showing that the first layer decoded signal does not contain the background noise, to corrected LPC calculating section 708. Further, as a background noise detection method, this embodiment can employ a method of analyzing input signals of a certain period, calculating the maximum power value and the minimum power value of the input signals and using the minimum power value as noise when the ratio of the maximum power value to the minimum value or the difference between the maximum power value and the minimum power value is equal to or greater than a threshold, as well as other general background noise detection methods. Further, with this embodiment, although background noise detecting section 706 decides whether or not the first layer decoded signal contains background noise, the present invention is not limited to this, and can be applied in the same way to a case where whether or not the second layer decoded signal and the third layer decoded signal contain background noise is detected or when information of background noise contained in the input signals is transmitted from the coding apparatus and the transmitted background noise information is utilized.

Switching section 705 decides whether or not decoded signals of which layer can be obtained, based on layer information outputted from demultiplexing section 701 and outputs the decoded signals in the layer of the highest order to corrected LPC calculating section 708 and filter section 707.

The post filter has corrected LPC calculating section 708 and filter section 707, calculates corrected LPC coefficients using layer information outputted from demultiplexing section 701, the decoded signals outputted from switching section 705 and background noise information obtained at background noise detecting section 706, and outputs the calculated corrected LPC coefficients to filter section 707. Details of corrected LPC calculating section 708 will be described.

Filter section 707 forms a filter with the corrected LPC coefficients outputted from corrected LPC calculating section 708, carries out post filter processing of the decoded signals outputted from switching section 705 and outputs the decode signals subjected to post filter processing.

Figure 19:
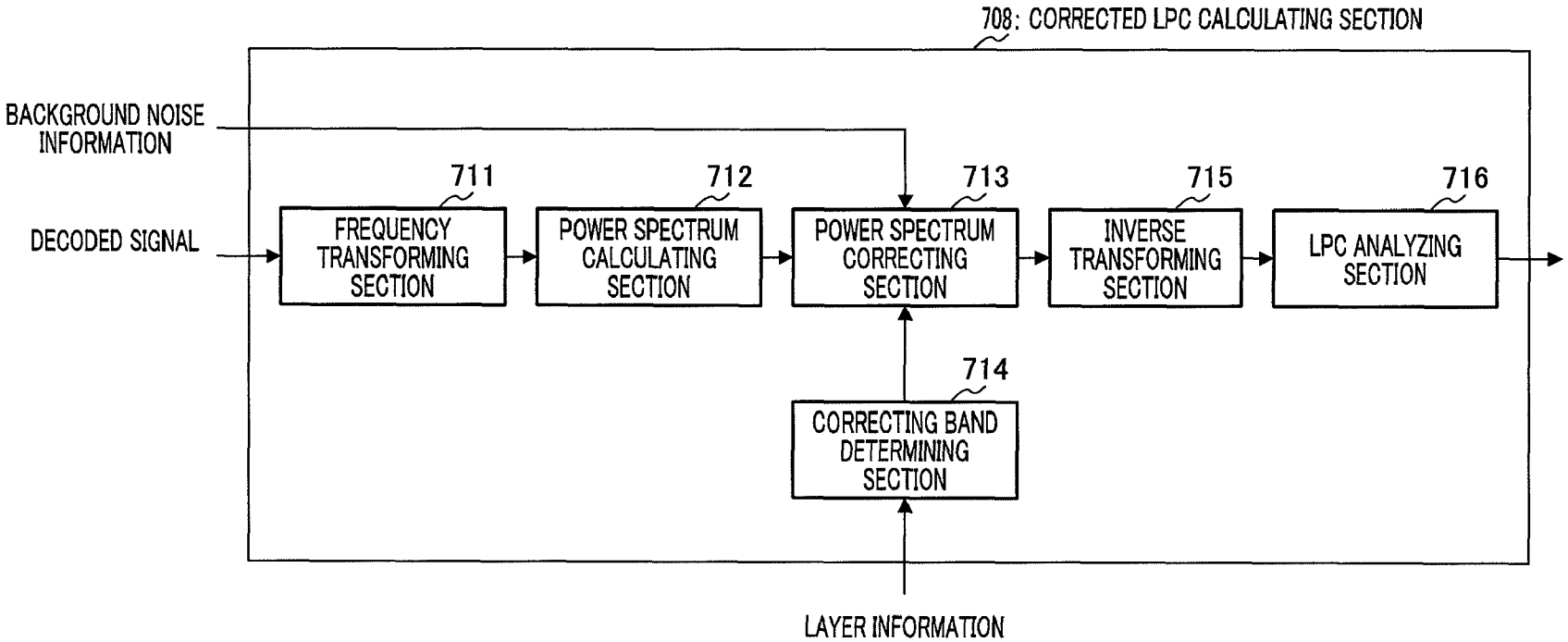
FIG. 19 is a block diagram showing the main configuration inside the corrected LPC calculating section according to Embodiment 7.

FIG. 19 is a block diagram showing the configuration inside corrected LPC calculating section 708 shown in FIG. 18. In this figure, frequency transforming section 711 carries out a frequency analysis of the decoded signals outputted from switching section 705, finding the spectrum of the decoded signals (hereinafter simply the "decoded spectrum") and outputting the determined decoded spectrum to power spectrum calculating section 712.

Power spectrum calculating section 712 calculates the power of the decoded spectrum (hereinafter simply the "power spectrum") outputted from frequency transforming section 711 and outputs the calculated power spectrum to power spectrum correcting section 713.

Correcting band determining section 714 determines bands (hereinafter simply "correcting bands") for correcting the power spectrum, based on layer information outputted from demultiplexing section 701, and outputs the determined bands to power spectrum correcting section 713 as correcting band information.

Figure 20:
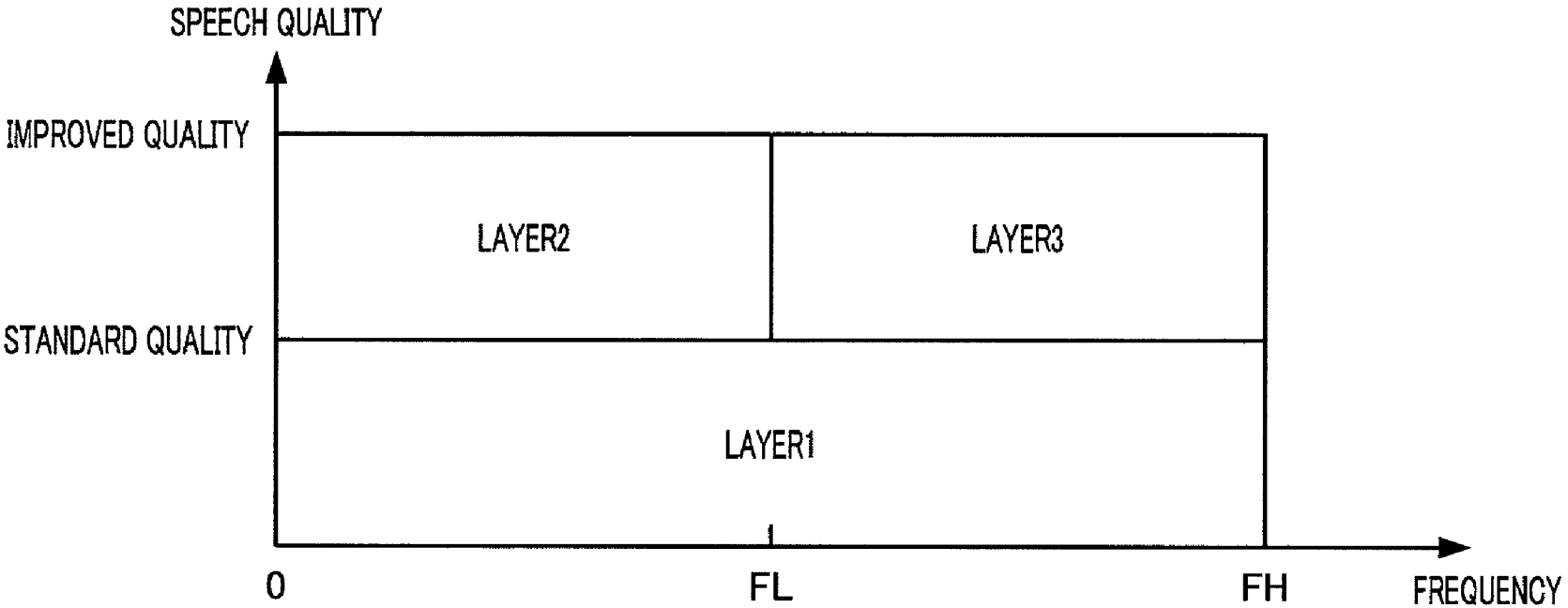
FIG. 20 is a schematic diagram showing a signal band and speech quality of each layer according to Embodiment 7.

In this embodiment, the layers shown in FIG. 20 support signal bands and speech quality, and correcting band determining section 714 generates the correcting band information based on the correcting band equaling 0 (not corrected) when the layer information shows layer 1, the correcting band between 0 and FL when the layer information shows layer 2 and the correcting band between 0 and FH when the layer information shows layer 3.

Power spectrum correcting section 713 corrects the power spectrum outputted from power spectrum calculating section 712 based on the correcting band information and background noise information outputted from correcting band determining section 714 and outputs the corrected power spectrum to inverse transforming section 715.

Here, "power spectrum correction" refers to, when background noise information shows that "first decoded signal does not contain background noise," setting post filter characteristics poor, such that the spectrum is modified less. To be more specific, power spectrum correction refers to carrying out modification such that changes in the power spectrum in the frequency domain are reduced. By this means, when the layer information shows layer 2, the post filter characteristics in the band between 0 and FL is set poor, and when the layer information shows layer 3, the post filter characteristics in the band between 0 and FH is set poor. Further, when background noise information shows that "the first decoded signal contains background noise," power spectrum correcting section 713 does not carry out processing as described above so as to set post filter characteristics poor or carry out processing such that the degree of setting the post filter characteristics poor is set less to some extent. In this way, by switching post filter processing according to whether or nor the first decoded signal contains background noise (whether or not the input signal contains background noise), when the signal does not contain background noise, noise in the decoded signal can be made less distinct and, when the signal contains background noise, band quality of the decoded signals can be increased as much as possible, so that it is possible to generate the decoded signals with better subjective quality.

Inverse transforming section 715 inverts the corrected power spectrum outputted from power spectrum correcting section 713 and finds an autocorrelation function. The determined autocorrelation function is outputted to LPC analyzing section 716. Further, inverse transforming section 715 is able to reduce the amount of calculation by utilizing the FFT (Fast Fourier Transform). At this time, when the order of the corrected power spectrum cannot be represented by $2^N$, the corrected power spectrum may be averaged such that the analysis is $2^N$, or the corrected power spectrum may be punctured.

LPC analyzing section 716 finds LPC coefficients by applying an autocorrelation method to the autocorrelation function outputted from inverse transforming section 715 and outputs the determined LPC coefficients to filter section 707 as corrected LPC coefficients.

Next, methods of implementing above power spectrum correcting section 713 will be described in detail. First, a method of smoothing the power spectrum in the correcting band will be described as the first realization method. This method refers to calculating an average value of a power spectrum in the correcting band and replacing the spectrum before smoothing with the calculated average value.

Figure 21:
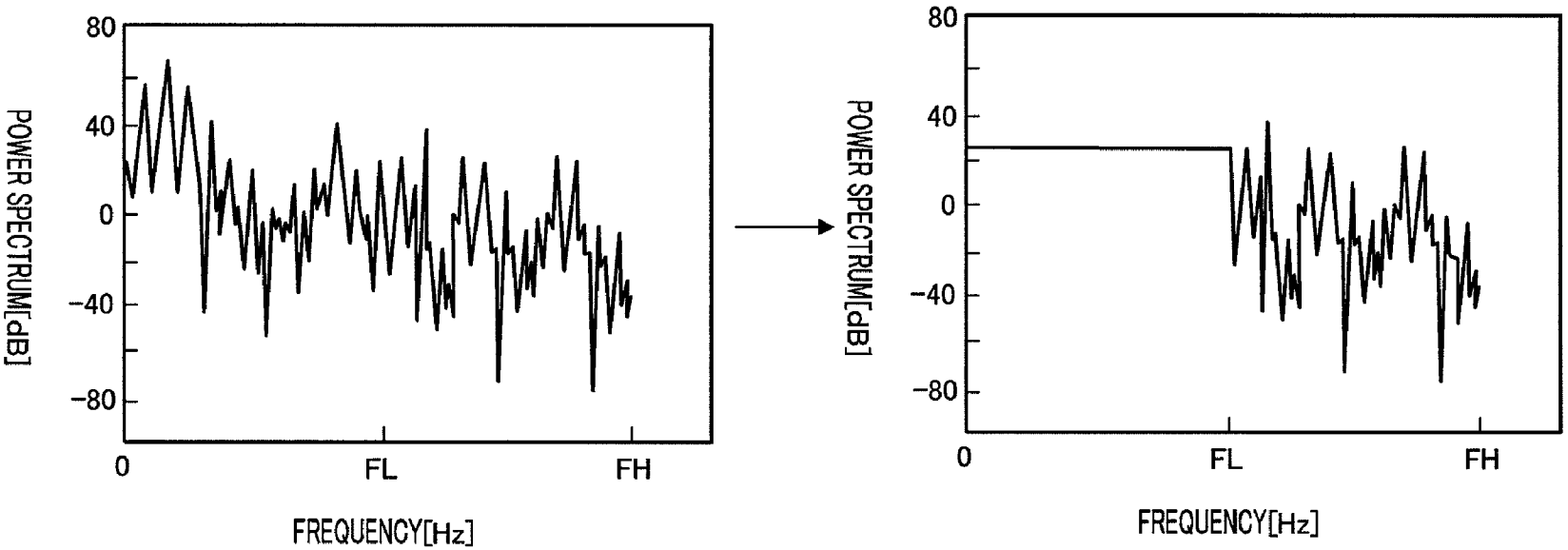
FIG. 21 shows spectral characteristics showing how a power spectrum is corrected by the first realization method according to Embodiment 7.

FIG. 21 shows how the power spectrum is corrected according to the first realization method. This figure shows how the power spectrum of the voiced part (/o/) of the female is corrected when the layer information shows layer 2 (the post filter characteristics in the band between 0 and FL are set poor) and shows replacement of the band between 0 and FL with a power spectrum of approximately 22 dB. At this time, it is preferable to correct the power spectrum such that the spectrum does not change discontinuously at a portion connecting the band to be corrected and the band not to be corrected. The details of this method includes, for example, finding an average value of changes in the power spectrum of the boundary and its vicinity and replacing the target power spectrum with the average value of changes. As a result, it is possible to find the corrected LPC coefficients reflecting the more accurate spectral characteristics.

Next, a second method of realizing power spectrum correcting section 713 will be described. The second realization method refers to finding a spectral slope of the power spectrum of the correcting band and replacing the spectrum of the band with the spectral slope. Here, the "spectral slope" refers to the overall slope of the power spectrum of the band. For example, the spectral characteristics of a digital filter formed by a PARCOR coefficient (i.e. reflection coefficient) of the first order of a decoded signal or by multiplying the PARCOR coefficient by a constant. The power spectrum of the band is replaced with this spectral characteristics multiplied by coefficients calculated such that energy of the power spectrum in the band is stored.

Figure 22:
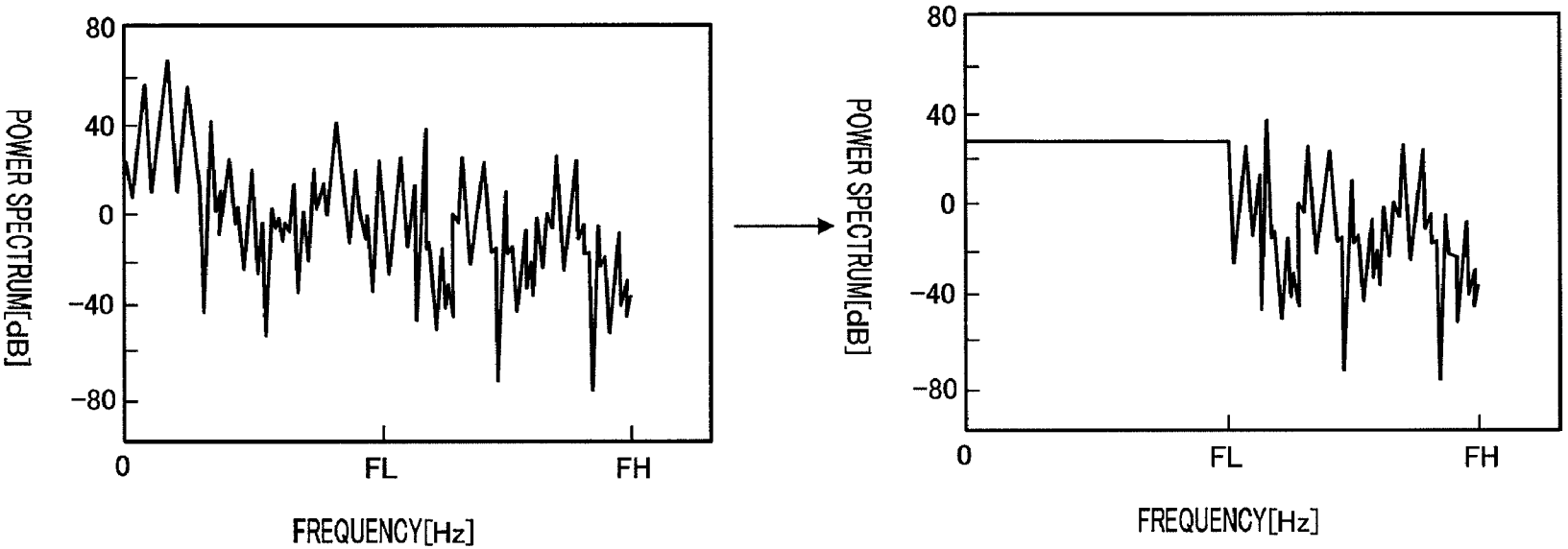
FIG. 22 shows spectral characteristics showing how a power spectrum is corrected by the second realization method according to Embodiment 7.

FIG. 22 shows how the power spectrum is corrected according to the second realization method. In this figure, the power spectrum of the band between 0 and FL is replaced with the power spectrum sloped between approximately 23 dB to 26 dB.

Here, transfer function PF of a typical post filter is represented by following equation 12. Here, a(i) in equation 12 is an LPC (linear prediction coding) coefficient of the decoded signal, NP is the order of the LPC coefficients, $\gamma_n$ and $\gamma_d$ are set values ($0<\gamma_n<\gamma_d<1$) for determining the degree for noise reduction by the post filter and $\mu$ is a set value for compensating a spectral slope generated by the format emphasis filter.

(Equation 12)

$$PF(z) = F(z) \cdot U(z) \quad [12]$$

$$F(z) = \frac{1 - \sum_{i=1}^{NP} \alpha(i)\gamma_n^i z^{-i}}{1 - \sum_{i=1}^{NP} \alpha(i)\gamma_d^i z^{-i}}$$

$$U(z) = 1 - \mu \cdot z^{-1}$$

By replacing the power spectrum of the correcting band with a spectral slope as described above, the effects of emphasizing the high band by a tilt compensation filter (i.e. U(z) of equation 12) of the post filter cancel each other within the band. That is, the spectral characteristics equaling the opposite characteristics to the spectral characteristics U(z) of equation 12 is given. By this means, the spectral characteristics of the band including the post filter can further be smoothed.

Further, a third method of realizing power spectrum correcting section 713 may use the $\alpha$-th ($0<\alpha<1$) power of the power spectrum of the correcting band. This method enables more flexible design of the post filter characteristics compared to the above method of smoothing the power spectrum.

Next, the spectral characteristics of the post filter formed with the above corrected LPC coefficient calculated by corrected LPC calculating section 708 will be described with reference to FIG. 23. Here, a case will be described with the spectral characteristics as an example where the corrected LPC coefficient is determined using the spectrum shown in FIG. 22 and the set values of the post filter are $\gamma_n$=0.6, $\gamma_d$=0.8 and $\mu$=0.4. Further, the LPC coefficients have the eighteenth order.

Figure 23:
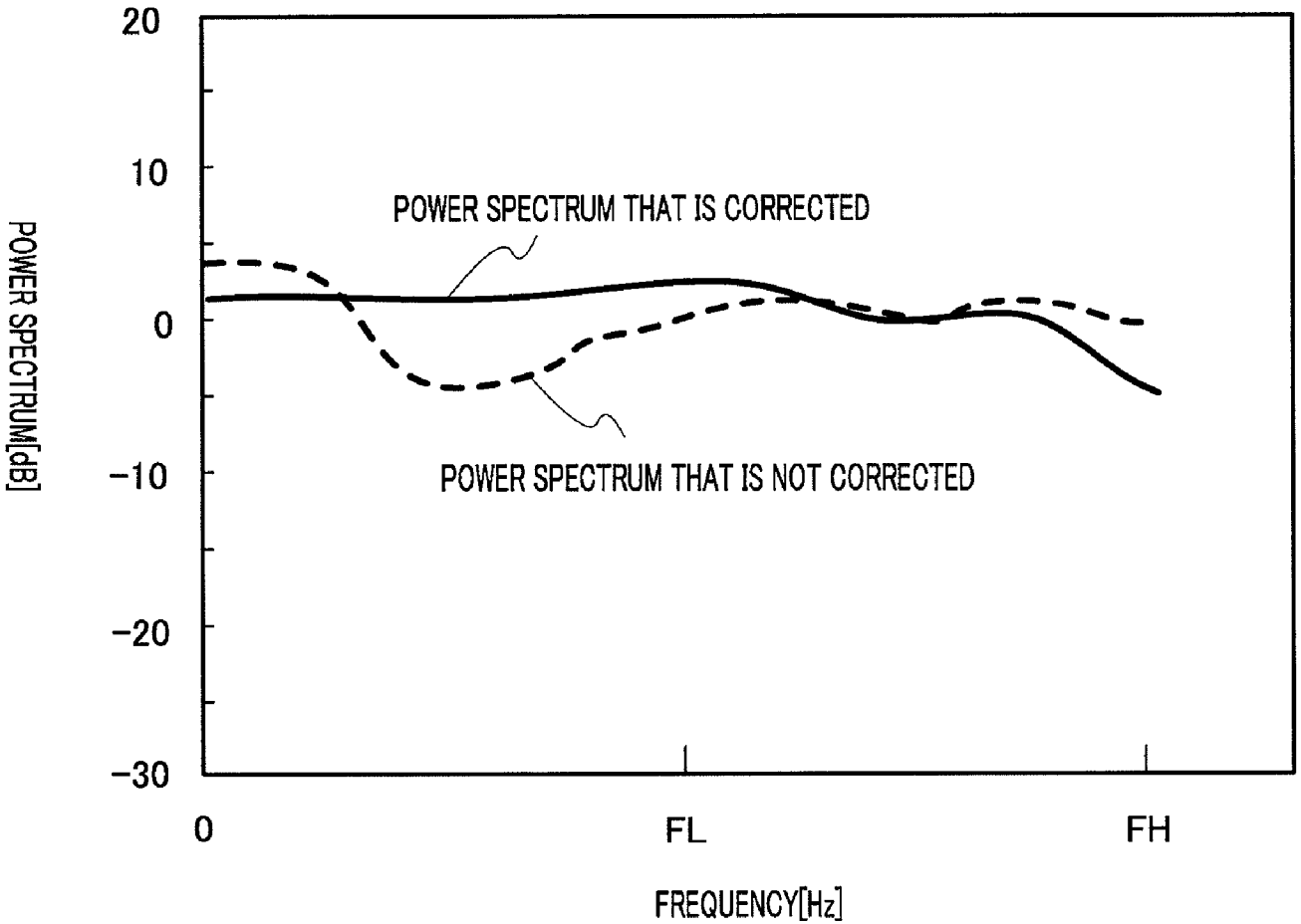
FIG. 23 shows spectral characteristics of a post filter formed using corrected LPC coefficients according to Embodiment 7.

The solid line shown in FIG. 23 shows the spectral characteristics when the power spectrum is corrected and the dotted line shows the spectral characteristics when the power spectrum is not corrected (that is, the set values are the same as above). As shown in FIG. 23, when the power spectrum is corrected, the post filter characteristics become almost smoothed in the band between 0 and FL and become the same spectral characteristics in the band between FL and FH as in the case where the power spectrum is not corrected.

On the other hand, although in the vicinity of the Nyquist frequency, when the power spectrum is corrected, the spectral characteristics become attenuated a little compared to the spectral characteristics when the power spectrum is not corrected, the signal component in this band is smaller than signal components in other bands, and so this influence can be almost ignored.

In this way, according to Embodiment 7, the power spectrum of a band matching with layer information is corrected, corrected LPC coefficients are calculated based on the corrected power spectrum and a post filter is formed using the calculated corrected LPC coefficient, so that, even when speech quality varies between bands supported by layers, it is possible to carry out post filtering of decoded signals based on the spectral characteristics according to speech quality and, consequently, improve speech quality.

Further, a case has been described with this embodiment where, when layer information shows any one of layer 1 to layer 3, corrected LPC coefficients are calculated. When a layer processes all bands, which carries out encoding, for approximately the same speech quality (in this embodiment, layer 1 processing full bands for standard quality and layer 3 processing full bands for improved quality), the corrected LPC coefficients need not to be calculated per band. In this case, set values ($\gamma_d$, $\gamma_n$ and $\mu$) specifying the degree of the post filter may be prepared per layer in advance and the post filter may be directly formed by switching the prepared set values. By this means, it is possible to reduce the amount and time of processing required to calculate corrected LPC coefficients.

Further, with this embodiment, although power spectrum correcting section 713 carries out processing common to the full band according to whether or not the first layer decoded signal contains background noise, the present invention is not limited to this, and can be applied in the same way to a case where background noise detecting section 706 calculates the frequency characteristics of background noise contained in the first layer decoded signal and power spectrum correcting section 713 switches power spectrum correction methods using the result on a per subband basis.

Embodiment 8

Figure 24:
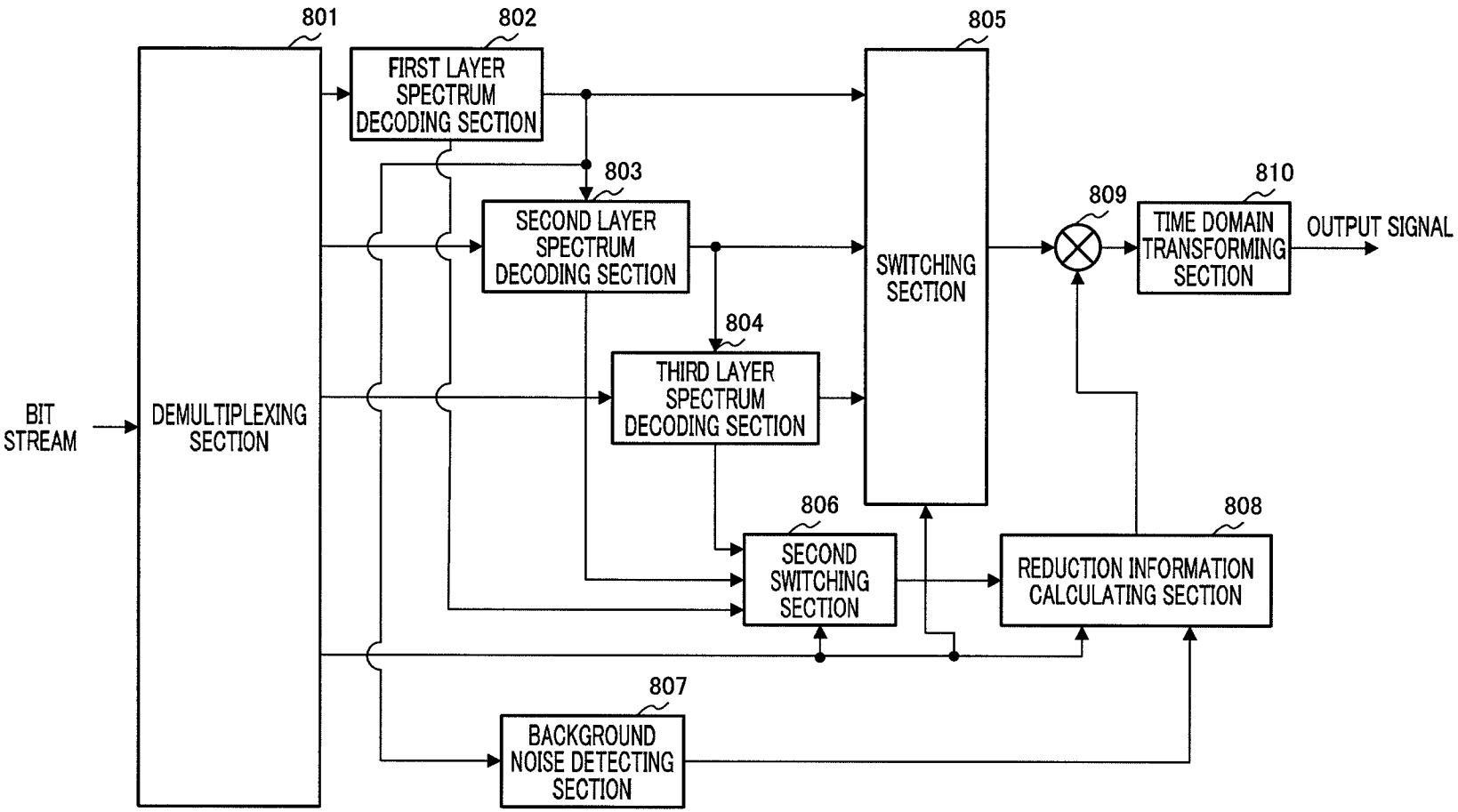
FIG. 24 is a block diagram showing the main configuration of the scalable decoding apparatus according to Embodiment 8.

FIG. 24 is a block diagram showing the main configuration of the scalable decoding apparatus according to Embodiment 8 of the present invention. Only the different sections from FIG. 18 will be described here. In this figure, second switching section 806 acquires layer information from demultiplexing section 801, decides the decoded spectrum of which layer can be obtained based on acquired layer information and outputs the decoded LPC coefficients in the layer of the highest order to reduction information calculating section 808. However, the decoded LPC coefficients may not be likely to be generated in the decoding process, and, in this case, one decoded LPC coefficient among the decoding coefficients acquired at second switching section 806 is selected.

Background noise detecting section 807 receives the first layer decoded signal and decides whether or not background the signal contains noise. If background noise analyzing section 506 decides that background noise is contained in the first decoded signals, background noise analyzing section 807 analyzes the frequency characteristics of background noise by carrying out, for example, MDCT processing of the background noise and outputs background noise information as the analyzed frequency characteristics to reduction information calculating section 808. Further, if background noise analyzing section 506 decides that background noise is not contained in the first layer decoded signal, background noise analyzing section 807 outputs background noise information showing that the background noise is not contained in the first layer decoded signal, to reduction information calculating section 808. Furthermore, as a background noise detection method, this embodiment can employ a method of analyzing input signals of a certain period, calculating the maximum power value and the minimum power value of the input signals and using the minimum power value as noise when the ratio of the maximum power value to the minimum value or the minimum power or the difference between the maximum power value and the minimum power value is equal to or greater than a threshold, as well as other general background noise detection methods. Further, with this embodiment, although background noise detecting section 706 decides whether or not the first layer decoded signal contains background noise, the present invention is not limited to this, and can be applied in the same way to a case where whether or not the second layer decoded signal and the third layer decoded signal contain background noise is detected or when information of background noise contained in the input signals is transmitted from the coding apparatus and the transmitted background noise information is utilized.

Reduction information calculating section 808 calculates reduction information using layer information outputted from demultiplexing section 801, the LPC coefficients outputted from second switching section 806 and background noise information outputted from background noise detecting section 807, and outputs calculated reduction information to multiplier 809. Details of reduction information calculating section 808 will be described.

Multiplier 809 multiplies the decoded spectrum outputted from switching section 805 by reduction information outputted from reduction information calculating section 808 and outputs the decoded spectrum multiplied by reduction information to time domain transforming section 810.

Time domain transforming section 810 carries out inverse MDCT processing of the decoded spectrum outputted from multiplier 809, multiplies the decoded spectrum by an adequate window function, and then adds corresponding domains of the decoded spectrum and the signal of the previous frame after windowing, and generates and outputs a second layer decoded signal.

Figure 25:
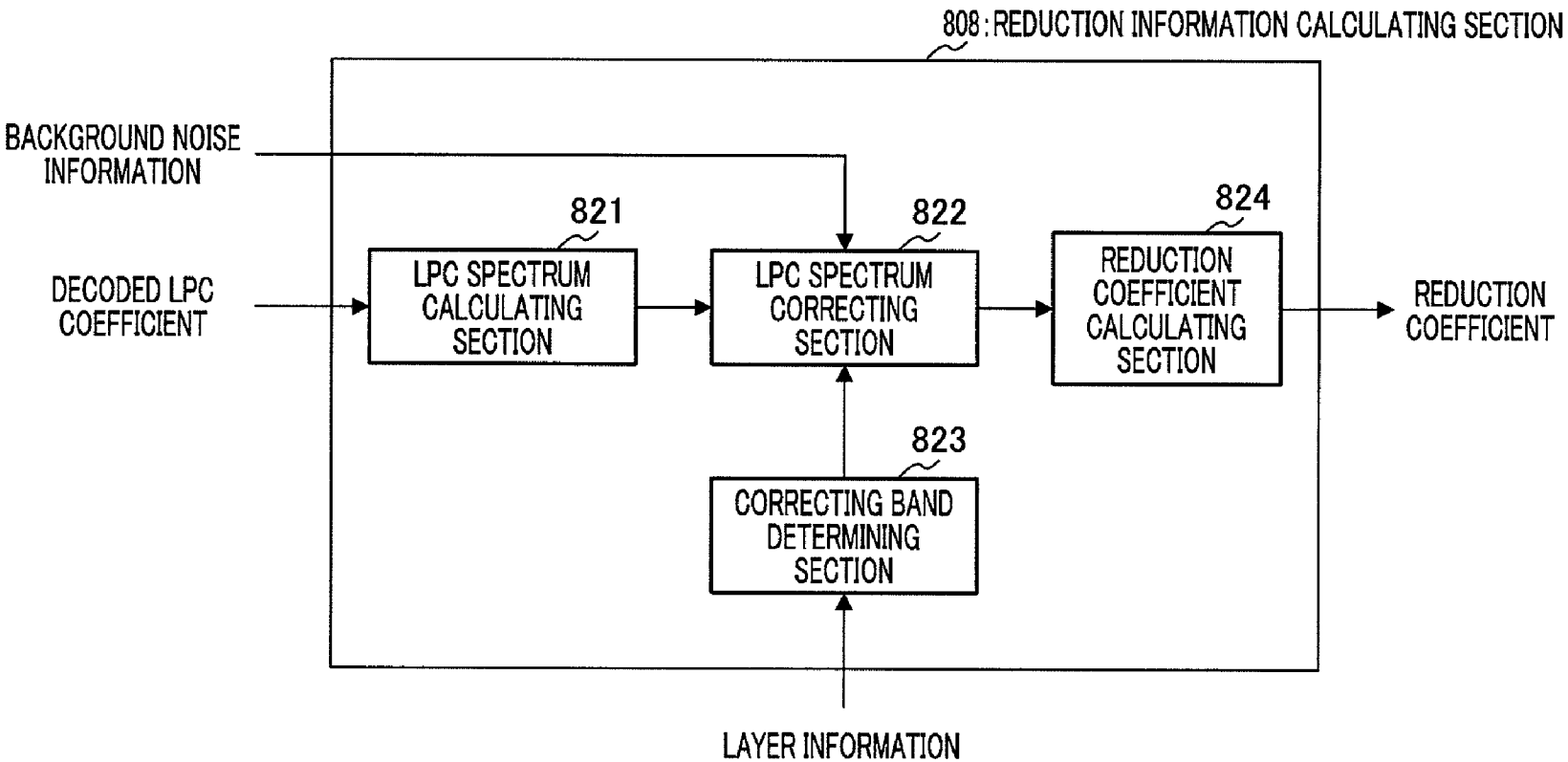
FIG. 25 is a block diagram showing the main configuration inside reduction information calculating section according to Embodiment 8.

FIG. 25 is a block diagram showing the configuration in reduction information calculating section 808 shown in FIG. 24. In this figure, LPC spectrum calculating section 821 carries out discrete Fourier transform of the decoded LPC coefficients outputted from second switching section 806, calculates the energy of each complex spectrum and outputs the calculated energy to LPC spectrum correcting section 822 as an LPC spectrum. That is, when the decoded LPC coefficient is represented by $\alpha(i)$, a filter represented by following equation 13 is formed.

(Equation 13)

$$P(z) = \frac{1}{A(z)} = \frac{1}{1 - \sum_{i=1}^{NP} \alpha(i) \cdot z^{-i}} \quad [13]$$

LPC spectrum calculating section 821 calculates the spectral characteristics of the filter represented by above equation 13 and outputs the result to LPC spectrum correcting section 822. Here, NP is the order of the decoded LPC coefficient.

Further, the spectral characteristics of a filter may be calculated ($0<\gamma_n<\gamma_d<1$) by forming this filter represented by following equation 14 using predetermined parameters $\gamma_n$ and $\gamma_d$ for adjusting the degree of reducing noise.

(Equation 14)

$$P(z) = \frac{A(z/\gamma_n)}{A(z/\gamma_d)} = \frac{1 - \sum_{i=1}^{NP} \alpha(i) \cdot \gamma_n^i \cdot z^{-i}}{1 - \sum_{i=1}^{NP} \alpha(i) \cdot \gamma_d^i \cdot z^{-i}} \quad [14]$$

Further, although cases might occur where the filters represented by equation 13 and equation 14 have characteristics that the low band (or high band) is excessively emphasized compared to the high band (or low band) (these characteristics are generally referred to as a "spectral slope"), a filter (i.e. anti-tilt filter) for compensating for the characteristics may be used together.

Similar to power spectrum correcting section 713 in Embodiment 7, LPC spectrum correcting section 822 corrects the LPC spectrum outputted from LPC spectrum calculating section 821, based on correcting band information outputted from correcting band determining section 823, and outputs the corrected LPC spectrum to reduction coefficient calculating section 824.

Reduction coefficient calculating section 824 calculates reduction coefficients according to the following method.

That is, reduction coefficient calculating section 824 divides the correcting LPC spectrum outputted from LPC spectrum correcting section 822 into subbands of a predetermined bandwidth and finds an average value per divided subband. Then, reduction coefficient calculating section 824 selects a subband having the determined average value smaller than a threshold value and calculates coefficients (i.e. vector values) of the selected subbands for reducing a decoded spectrum. By this means, it is possible to attenuate the subbands including the bands of spectral valleys. Moreover, the reduction coefficients are calculated based on the average value of the selected subbands. To be more specific, the calculation method refers to, for example, calculating the reduction coefficients by multiplying the average value of the subbands by the predetermined coefficients. Further, with respect to subbands having average values equal to or more than a predetermined threshold value, coefficients that do not change the decoded spectrum are calculated.

Further, the reduction coefficients need not be LPC coefficients and may be coefficients multiplied upon the decoded spectrum directly. By this means, it is not necessary to carry out inversion processing and LPC analysis processing, so that it is possible to reduce the amount of calculation required for these processings.

Reduction coefficient calculating section 824 may calculate reduction coefficients based on the method based on the following method. That is, reduction coefficient calculating section 824 divides the corrected LPC spectrum outputted from LPC spectrum correcting section 822 into subbands of a predetermined bandwidth and finds an average value per divided subband. Then, reduction coefficient calculating section 824 finds the subband having the maximum average value out of the subbands and normalizes the average value of the subbands using the average value of the subbands. The average values of the subbands after normalization are outputted as reduction coefficients.

Although a method has been described of outputting the reduction coefficients after the spectrum is divided into predetermined subbands, reduction coefficients may be calculated and outputted per frequency to determine the reduction coefficients more specifically. In this case, reduction coefficient calculating section 824 finds the maximum frequency among corrected LPC spectra outputted from LPC spectrum correcting section 822 and normalizes the spectrum of each frequency using the spectrum of this frequency. The normalized spectrum is outputted as reduction coefficients.

Further, when background noise information, inputted from reduction coefficient calculating section 824, shows that "the first layer decoded signal contains background noise," the definitive reduction coefficients calculated as described above are determined such that the effect of attenuating the subbands including the bands of spectral valleys decreases according to the background noise level. In this way, by switching post filter processing according to whether or not the first decoded signal contains background noise (whether or not the input signal contains background noise), when the signal does not contain background noise, noise in the decoded signal can be made less distinct and, when the signal contains background noise, band quality of the decoded signals can be increased as much as possible, so that it is possible to generate the decoded signals with better subjective quality.

In this way, according to Embodiment 8, the LPC spectrum calculated from the decoded LPC coefficients is a spectral envelope from which fine information of the decoded signals is removed, and, by directly finding the reduction coefficients based on this spectral envelope, an accurate post filter can be realized by a smaller amount of calculation, so that it is possible to improve speech quality. Further, by switching the reduction coefficients depending on whether or not the signal contains background noise (i.e. in the first layer decoded signal), it is possible to generate decoded signals of good subjective quality when the signal contains background noise and when background noise is not contained.

Embodiments of the present invention have been described.

Further, although cases have been described with Embodiments 1 to 3 and 5 to 8 as examples where the number of layers is two or three, the present invention can be applied to scalable coding of any number of layers as long as the number of layers is two or more.

Furthermore, although scalable coding has been described with Embodiments 1 to 3 and 5 to 8 as examples, the present invention can be applied to other layered encoding such as embedded coding.

Moreover, in this description, although cases have been described with the above embodiments as examples where speech signals are the encoding target, the present invention is not limited to this, and, for example, audio signals may be possible.

Further, in this description, although cases have been described as examples where MDCT is used as frequency conversion, the fast Fourier transform (FFT), Discrete Fourier Transform (DFT), DCT and subband filters may be used.

The transform coding apparatus and transform coding method according to the present invention are not limited to the above embodiments and can be realized by carrying out various modifications.

The scalable decoding apparatus according to the present invention can be provided in a communication terminal apparatus and base station apparatus in a mobile communication system, so that it is possible to provide a communication terminal apparatus, base station apparatus and mobile communication system having same advantages and effects as described above.

Also, although cases have been described with the above embodiment as examples where the present invention is configured by hardware. However, the present invention can also be realized by software. For example, it is possible to implement the same functions as in the transform coding apparatus of the present invention by describing algorithms of the transform coding method according to the present invention using the programming language, and executing this program with an information processing section by storing in memory.

Each function block employed in the description of each of the aforementioned embodiments may typically be implemented as an LSI constituted by an integrated circuit. These may be individual chips or partially or totally contained on a single chip.

"LSI" is adopted here but this may also be referred to as the "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The present application is based on Japanese Patent Application No. 2005-300778, filed on Oct. 14, 2005, and Japanese Patent Application No. 2006-272251, filed on Oct. 3, 2006, the entire content of which is expressly incorporated by reference herein.

INDUSTRIAL APPLICABILITY

The transform coding apparatus and transform coding method according to the present invention can be applied to a communication terminal apparatus and base station apparatus in a mobile communication system.

The invention claimed is:

1. A transform coding apparatus, comprising:

an input scale factor calculator that calculates a plurality of input scale factors associated with an input spectrum;

a codebook storage that stores a plurality of scale factors and outputs one of the plurality of scale factors;

a distortion calculator that calculates distortion between one of the plurality of input scale factors and the scale factor outputted from the codebook storage;

a weighted distortion calculator that calculates weighted distortion such that the calculated weighted distortion uses a higher weight when the one of the plurality of input scale factors is smaller than the scale factor outputted from the codebook storage, than when the one of the plurality of input scale factors is greater than the scale factor outputted from the codebook storage; and a searcher that searches for a scale factor that minimizes the weighted distortion in the codebook storage.

2. The transform coding apparatus according to claim 1, further comprising:

a determiner that adaptively determines a number of bits assigned in encoding of the input scale factors, wherein the weighted distortion calculator calculates weighted distortion using the weight with more weight when an input scale factor is assigned smaller number of bits.

3. The transform coding apparatus according to claim 1, further comprising:

a background noise detector that detects whether or not the input spectrum contains noise, wherein the weighted distortion calculator uses more weight in the distortion calculation when the one of the plurality of input scale factors is smaller than the scale factor outputted from the codebook storage than to the distortion of when the one of the plurality of input scale factors is greater than the scale factors outputted from the code book storage, and calculates the weighted distortion such that less weight is applied as a level of background noise detected in the background noise detector increases.

4. A communication terminal apparatus, comprising the transform coding apparatus according to claim 1.

5. A base station apparatus, comprising the transform coding apparatus according to claim 1.

6. A transform coding apparatus, comprising:

a first scale factor calculator that calculates a plurality of first scale factors associated with a first spectrum;

a second scale factor calculator that calculates a plurality of second scale factors associated with a second spectrum;

a codebook storage that stores a plurality of correcting coefficients and outputs one of the plurality of correcting coefficients;

a multiplier that multiplies the one of the plurality of first scale factors by the correcting coefficient outputted from the codebook storage and outputting a corrected one of the plurality of first scale factors;

a distortion calculator that calculates distortion between one of the plurality of second scale factors and the corrected first scale factor outputted from the multiplier;

a weighted distortion calculator that calculates weighted distortion such that the calculated weighted distortion uses higher weight when the one of the plurality of the second scale factors is smaller than the corrected first scale factor outputted from the multiplier than when the one of the plurality of the second scale factors is greater than the corrected first scale factor outputted from the multiplier; and a searcher that searches for a correcting coefficient that minimizes the weighted distortion in the codebook storage.

7. The transform coding apparatus according to claim 6, further comprising:

a similarity calculator that calculates a similarity between the first spectrum and the second spectrum, wherein the weighted distortion calculator calculates weighted distortion using the weight with more weight when a second scale factor has a lower similarity to the first scale factor.

8. The transform coding apparatus according to claim 6, further comprising:

a background noise detector that detects whether or not one or both of the first spectrum and the second spectrum contain noise, wherein the weighted distortion calculator uses more weight in the distortion calculation when the one of the plurality of second factors is smaller than the corrected first scale factor outputted from the multiplier than to the distortion when the one of the plurality of second scale factors is greater than the corrected first scale factor outputted from the multiplier, and calculating the weighted distortion such that less weight is applied as a level of background noise detected in the background noise detector increases.

9. A transform coding method, comprising:

calculating, by a calculator, a plurality of input scale factors associated with an input spectrum;

selecting, by a selector, one of a plurality of scale factors from a codebook storage that stores the plurality of scale factors;

calculating, by a calculator, distortion between one of the plurality of input scale factors and the selected scale factor;

calculating, by a calculator, weighted distortion such that the calculated weighted distortion uses higher weight when the one of the plurality of the input scale factors is smaller than the selected scale factor, than when the one of the plurality of the input scale factors is greater than the selected scale factor; and searching, by a searcher, for a scale factor that minimizes the weighted distortion in the codebook storage.

10. A transform coding method, comprising:

calculating, by a calculator, a plurality of input scale factors associated with an input spectrum;

selecting, by a selector, one of a plurality of scale factors from a codebook storage that stores the plurality of scale factors;

detecting, by a detector, whether or not the input spectrum contains noise;

calculating, by a calculator, distortion between one of the plurality of input scale factors and the selected scale factor; and searching, by a searcher, for a scale factor that minimizes the weighted distortion in the codebook storage, wherein the distortion is calculated by using more weight to the distortion when the one of the plurality of input scale factors is smaller than the selected scale factor than when the distortion of the one of the plurality of the input scale factors is greater than the selected scale factor, and calculating weighted distortion such that less weight is applied as a level of background noise detected in the background noise detecting section increases.

* * * * *